US008353693B2

(12) United States Patent
Sotojima et al.

(10) Patent No.: US 8,353,693 B2
(45) Date of Patent: Jan. 15, 2013

(54) FLUID MACHINE

(75) Inventors: Takazou Sotojima, Sakai (JP); Yoshitaka Shibamoto, Sakai (JP); Takashi Shimizu, Sakai (JP); Kazuhiro Furusho, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 379 days.

(21) Appl. No.: 12/866,008

(22) PCT Filed: Feb. 4, 2009

(86) PCT No.: PCT/JP2009/000431

§ 371 (c)(1),
(2), (4) Date: Aug. 3, 2010

(87) PCT Pub. No.: WO2009/098872

PCT Pub. Date: Aug. 13, 2009

(65) Prior Publication Data

US 2010/0326128 A1 Dec. 30, 2010

(30) Foreign Application Priority Data

Feb. 4, 2008 (JP) ..... 2008-023704
Sep. 29, 2008 (JP) ..... 2008-250917

(51) Int. Cl.
*F03C 2/00* (2006.01)
*F04C 18/00* (2006.01)
*F04C 2/00* (2006.01)

(52) U.S. Cl. ..... 418/59; 418/12

(58) Field of Classification Search ..... 418/11–12, 418/55.5, 57–59, 107; 417/410.3, 410.1
See application file for complete search history.

(56) References Cited

U.S. PATENT DOCUMENTS

| | | | |
|---|---|---|---|
| 7,534,100 | B2 | 5/2009 | Masuda |
| 7,607,904 | B2 | 10/2009 | Masuda |
| 2007/0036666 | A1 | 2/2007 | Masuda |
| 2007/0041852 | A1 | 2/2007 | Masuda |
| 2007/0065324 | A1 | 3/2007 | Masuda |
| 2007/0224073 | A1 | 9/2007 | Masuda |
| 2008/0232991 | A1 | 9/2008 | Masuda |
| 2008/0240958 | A1 | 10/2008 | Masuda |
| 2009/0013714 | A1 | 1/2009 | Yamaguchi et al. |

FOREIGN PATENT DOCUMENTS

| | | | |
|---|---|---|---|
| CN | 1981133 | A | 6/2007 |

(Continued)

OTHER PUBLICATIONS

Partial Translation of Japanese Patent Publication No. 2000-87892 submitted the Aug. 3, 2010 Information Disclosure Statement with machine translation.

*Primary Examiner* — Theresa Trieu
(74) *Attorney, Agent, or Firm* — Global IP Counselors

(57) ABSTRACT

A fluid machine includes an inflow passageway arranged and configured to introduce fluid from outside into inner and outer fluid chambers of a first eccentric rotation mechanism, a communication passageway arranged and configured to introduce fluid discharged from the inner and outer fluid chambers of the first eccentric rotation mechanism into inner and outer fluid chambers of a second eccentric rotation mechanism, and an outflow passageway arranged and configured to allow fluid discharged from the inner and outer fluid chambers of the second eccentric rotation mechanism to flow to outside. Each of the first and second eccentric rotation mechanisms preferably includes a cylinder, a piston, and a blade. A drive shaft has a main shaft portion and first and second eccentric portions arranged to engage the first and second eccentric rotation mechanisms.

13 Claims, 11 Drawing Sheets

FOREIGN PATENT DOCUMENTS

| | | | |
|---|---|---|---|
| JP | 2000-087892 | A | 3/2000 |
| JP | 2004-100608 | A | 4/2004 |
| JP | 2005-320927 | A | 11/2005 |
| JP | 2005-320929 | A | 11/2005 |
| JP | 2007-239666 | A | 9/2007 |
| JP | 2007-263109 | A | 10/2007 |
| WO | WO-2005/103496 | A1 | 11/2005 |
| WO | WO-2005/113985 | A1 | 12/2005 |

FLUID MACHINE

CROSS-REFERENCE TO RELATED APPLICATIONS

This U.S. National stage application claims priority under 35 U.S.C. §119(a) to Japanese Patent Application Nos. 2008-023704, filed in Japan on Feb. 4, 2008, and 2008-250917, filed in Japan on Sep. 29, 2008, the entire contents of which are hereby incorporated herein by reference.

TECHNICAL FIELD

The present invention relates to a fluid machine for compressing fluid or expanding fluid.

BACKGROUND ART

Fluid machines for compressing fluid or expanding fluid are known in the art. An example of a fluid machine of this type is disclosed in Japanese Published Patent Application No. 2007-239666, for example.

Specifically, Japanese Published Patent Application No. 2007-239666 discloses, as a fluid machine of this type, a compressor for performing two-stage compression of refrigerant. The compressor includes two eccentric rotation mechanisms. Each eccentric rotation mechanism includes compression chambers, one formed on the inner side and the other on the outer side of an annular piston. In a two-stage compression operation in which refrigerant is compressed in two stages, the first compression chamber of the first eccentric rotation mechanism and the second compression chamber of the second eccentric rotation mechanism serve as compression chambers of the lower-stage side, and the third compression chamber of the first eccentric rotation mechanism and the fourth compression chamber of the second eccentric rotation mechanism serve as compression chambers of the higher-stage side. That is, in each eccentric rotation mechanism, one compression chamber serves as a lower-stage compression chamber with the other compression chamber serving as a higher-stage compression chamber.

SUMMARY

Technical Problem

Now, with a fluid machine having an eccentric rotation mechanism in which fluid chambers are formed, one on the inner side and the other on the outer side of an annular piston, the volume ratio between the outer fluid chamber formed on the outer side of the annular piston and the inner fluid chamber formed on the inner side of the annular piston is somewhat dictated geometrically, and it is difficult to freely set the volume ratio.

Here, where a conventional fluid machine having two eccentric rotation mechanisms as described above is used as a compressor, one of the outer fluid chamber and the inner fluid chamber in each eccentric rotation mechanism serves as a lower-stage fluid chamber for compressing low-pressure refrigerant to an intermediate pressure with the other serving as a higher-stage fluid chamber for compressing the intermediate-pressure refrigerant to a high pressure. Therefore, it was difficult with the conventional fluid machine to freely set the ratio (suction volume ratio) of the suction volume of the higher-stage fluid chamber with respect to the suction volume of the lower-stage fluid chamber. Similarly, where the fluid machine is used as an expander, it is difficult to freely set the suction volume ratio.

The present invention has been made in view of such problems, and has an object to provide a fluid machine having an eccentric rotation mechanism in which fluid chambers are formed, one on the inner side and the other on the outer side of an annular piston, wherein the ratio of the suction volume of the higher-stage fluid chamber with respect to the suction volume of the lower-stage fluid chamber can be easily set to a predetermined ratio.

Solution to the Problem

A first aspect of the invention is directed to a fluid machine (20) including: a first eccentric rotation mechanism (24) and a second eccentric rotation mechanism (25), each of which include a cylinder (52,56) having an annular cylinder chamber (54,58), an annular piston (53,57) accommodated in the cylinder chamber (54,58) while being eccentric with the cylinder (52,56) so as to divide the cylinder chamber (54,58) into an outer fluid chamber (61,63) and an inner fluid chamber (62,64), and a blade (45) arranged in the cylinder chamber (54,58) for dividing each fluid chamber (61-64) into a first chamber and a second chamber, wherein the cylinder (52,56) and the piston (53,57) move in eccentric rotation relative to each other; and a drive shaft (23) including a main shaft portion (23*a*), a first eccentric portion (23*b*) to be engaged with the first eccentric rotation mechanism (24) while being eccentric with an axis of the main shaft portion (23*a*), and a second eccentric portion (23*c*) to be engaged with the second eccentric rotation mechanism (25) while being eccentric with the axis of the main shaft portion (23*a*), wherein the fluid machine (20) compresses or expands fluid in each of the fluid chambers (63,64) of the first eccentric rotation mechanism (24) and the second eccentric rotation mechanism (25).

The fluid machine (20) includes: an inflow passageway (32) for introducing fluid from outside into the fluid chambers (61,62) of the first eccentric rotation mechanism (24); a communication passageway (33) for introducing fluid discharged from the fluid chambers (61,62) of the first eccentric rotation mechanism (24) into the fluid chambers (63,64) of the second eccentric rotation mechanism (25); and an outflow passageway (31) for allowing fluid discharged from the fluid chambers (63,64) of the second eccentric rotation mechanism (25) to flow to outside.

A second aspect of the invention is according to the first aspect of the invention, wherein the fluid introduced from outside is compressed in the fluid chambers (61,62) of the first eccentric rotation mechanism (24), and the fluid which has been compressed in the fluid chambers (61,62) of the first eccentric rotation mechanism (24) is further compressed in the fluid chambers (63,64) of the second eccentric rotation mechanism (25).

A third aspect of the invention is according to the first or second aspect of the invention, wherein the inflow passageway (32) is formed by one passageway communicated to the outer fluid chamber (61) and the inner fluid chamber (62) of the first eccentric rotation mechanism (24), and the communication passageway (33) is formed by one passageway communicated to the outer fluid chamber (63) and the inner fluid chamber (64) of the second eccentric rotation mechanism (25).

A fourth aspect of the invention is according to one of the first to third aspects of the invention, wherein an outer discharge port (65,75) for discharging fluid from the outer fluid chamber (61,63), and an inner discharge port (66,76) for discharging fluid from the inner fluid chamber (62,64) are formed at each eccentric rotation mechanism (24,25), the outer discharge port (65) and the inner discharge port (66) of the first eccentric rotation mechanism (24) are opened into a first discharge space (46) which communicates with the communication passageway (33), and the outer discharge port (75) and the inner discharge port (76) of the second eccentric rotation mechanism (25) are opened into a second discharge space (47) which communicates with the outflow passageway (31).

A fifth aspect of the invention is according to one of the first to fourth aspects of the invention, wherein each eccentric rotation mechanism (24,25) is configured so that the piston (53,57) moves in eccentric rotation with the cylinder (52,56) being fixed.

A sixth aspect of the invention is according to one of the first to fifth aspects of the invention, wherein the first eccentric rotation mechanism (24) and the second eccentric rotation mechanism (25) differ from each other in terms of a height of the cylinder chamber (54,58).

A seventh aspect of the invention is according to one of the first to sixth aspects of the invention, wherein the first eccentric portion (23*b*) and the second eccentric portion (23*c*) differ from each other in terms of a distance between an axis thereof and an axis of the main shaft portion (23*a*).

An eighth aspect of the invention is according to the second aspect of the invention, wherein in the eccentric rotation mechanisms (24,25), the cylinders (52,56) and the pistons (53,57) include end plate portions (51*a*,52*a*,55*a*,56*a*) whose front surfaces face the outer fluid chambers (61,63) and the inner fluid chambers (62,64), and the end plate portions (51*a*, 52*a*,55*a*,56*a*) of either the cylinders (52,56) or the pistons (53,57) which move in eccentric rotation form movable-side end plate portions (51*a*,52*a*,55*a*,56*a*), and the fluid machine includes partition structure or means (101,102) for forming high-pressure back pressure chambers (96,97) communicating with a gap surrounding the drive shaft (23) which provides a pressure of fluid discharged from the second eccentric rotation mechanism (25) on a back surface of the movable-side end plate portion (51*a*,52*a*) of the first eccentric rotation mechanism (24) and on a back surface of the movable-side end plate portion (55*a*,56*a*) of the second eccentric rotation mechanism (25).

A ninth aspect of the invention is according to the eighth aspect of the invention, wherein the first eccentric rotation mechanism (24) is arranged so that the back surface of the movable-side end plate portion (51*a*,52*a*) thereof faces toward the second eccentric rotation mechanism (25), the second eccentric rotation mechanism (25) is arranged so that the back surface of the movable-side end plate portion (55*a*, 56*a*) thereof faces toward the first eccentric rotation mechanism (24), the fluid machine includes a middle plate (41) interposed between the back surface of the movable-side end plate portion (51*a*,52*a*) of the first eccentric rotation mechanism (24) and the back surface of the movable-side end plate portion (55*a*,56*a*) of the second eccentric rotation mechanism (25), and the partition structure (101,102) include a first seal ring (101) for forming the high-pressure back pressure chamber (96) between one surface of the middle plate (41) and the back surface of the movable-side end plate portion (51*a*,52*a*) of the first eccentric rotation mechanism (24), and a second seal ring (102) for forming the high-pressure back pressure chamber (97) between the other surface of the middle plate (41) and the back surface of the movable-side end plate portion (55*a*,56*a*) of the second eccentric rotation mechanism (25).

A tenth aspect of the invention is according to one of the first to ninth aspects of the invention, wherein a first eccentric direction of the first eccentric portion (23*b*) in which the first eccentric portion (23*b*) is eccentric with the main shaft portion (23*a*) and a second eccentric direction of the second eccentric portion (23*c*) in which the second eccentric portion (23*c*) is eccentric with the main shaft portion (23*a*) are shifted from each other by a predetermined angle of 60° or more and 310° or less.

An eleventh aspect of the invention is according to the tenth aspect of the invention, wherein the first eccentric direction of the drive shaft (23) and the second eccentric direction of the drive shaft (23) are shifted from each other by 180°.

A twelfth aspect of the invention is according to one of the first to eleventh aspects of the invention, wherein the fluid machine is connected to a refrigerant circuit (10) filled with carbon dioxide as refrigerant for performing a refrigeration cycle.

—Functions—

In the first aspect of the invention, where the fluid machine (20) is used as a compressor, fluid which has been introduced into the fluid chambers (61,62) of the first eccentric rotation mechanism (24) through the inflow passageway (32) is compressed in the fluid chambers (61,62). Then, the fluid which has been discharged from the fluid chambers (61,62) of the first eccentric rotation mechanism (24) is introduced into the fluid chambers (63,64) of the second eccentric rotation mechanism (25) through the communication passageway (33), and is further compressed in the fluid chambers (63,64). The fluid which has been discharged from the fluid chambers (63,64) of the second eccentric rotation mechanism (25) is allowed to flow to the outside through the outflow passageway (31). That is, each fluid chamber (61,62) of the first eccentric rotation mechanism (24) serves as a lower-stage fluid chamber, and each fluid chamber (63,64) of the second eccentric rotation mechanism (25) serves as a higher-stage fluid chamber. On the other hand, where the fluid machine (20) is used as an expander, each fluid chamber (61,62) of the first eccentric rotation mechanism (24) serves as a higher-stage fluid chamber, and each fluid chamber (63,64) of the second eccentric rotation mechanism (25) serves as a lower-stage fluid chamber. In the first aspect of the invention, the lower-stage fluid chamber and the higher-stage fluid chamber are formed in separate eccentric rotation mechanisms (24, 25). Therefore, the suction volume ratio, which is the ratio between the suction volume of the lower-stage fluid chamber and the suction volume of the higher-stage fluid chamber, can be adjusted by the ratio between the height of the cylinder chamber (54) of the first eccentric rotation mechanism (24) and the height of the cylinder chamber (58) of the second eccentric rotation mechanism (25), or the ratio between the amount of eccentricity of the first eccentric portion (23*b*) (the distance between the axis of the main shaft portion (23*a*) and the axis of the first eccentric portion (23*b*)) and the amount of eccentricity of the second eccentric portion (23*c*) (the distance between the axis of the main shaft portion (23*a*) and the axis of the second eccentric portion (23*c*)).

In the second aspect of the invention, a two-stage compression is performed in which each fluid chamber (61,62) of the first eccentric rotation mechanism (24) serves as a lower-stage fluid chamber, and each fluid chamber (63,64) of the second eccentric rotation mechanism (25) serves as a higher-stage fluid chamber.

In the third aspect of the invention, fluid introduced into the outer fluid chamber (61) of the first eccentric rotation mechanism (24) and fluid introduced into the inner fluid chamber (62) thereof flow through the same passageway, and fluid introduced into the outer fluid chamber (63) of the second eccentric rotation mechanism (25) and fluid introduced into the inner fluid chamber (64) thereof flow through the same passageway. Here, in each eccentric rotation mechanism (24, 25), the flow rate of fluid sucked into the outer fluid chamber (61,63) and the inner fluid chamber (62,64) varies with the rotation of the drive shaft (23). Therefore, where fluid introduced into the outer fluid chamber (61,63) of each eccentric rotation mechanism (24,25) and fluid introduced into the inner fluid chamber (62,64) thereof flow through separate passageways, the flow rate of fluid flowing through each passageway varies substantially with the rotation of the drive shaft (23).

In contrast, in the third aspect of the invention, fluid introduced into the outer fluid chamber (61,63) of each eccentric rotation mechanism (24,25) and fluid introduced into the inner fluid chamber (62,64) thereof flow through the same passageway. The variation of the flow rate of fluid sucked into the outer fluid chamber (61,63) of each eccentric rotation mechanism (24,25) is in reversed phase with the variation of the flow rate of fluid sucked into the outer fluid chamber (61,63) of the other eccentric rotation mechanism (24,25). Therefore, the fluid flow rate variation in the inflow passageway (32), and the fluid flow rate variation in the communication passageway (33) are reduced.

In the fourth aspect of the invention, in the first eccentric rotation mechanism (24), the fluid of the outer fluid chamber (61) and the fluid of the inner fluid chamber (62) are discharged into the first discharge space (46). In the second eccentric rotation mechanism (25), the fluid of the outer fluid chamber (63) and the fluid of the inner fluid chamber (64) are discharged into the second discharge space (47). In each eccentric rotation mechanism (24,25), the fluid of the outer fluid chamber (61,63) and the fluid of the inner fluid chamber (62,64) are discharged into the same discharge space (46,47).

In the fifth aspect of the invention, each eccentric rotation mechanism (24,25) employs a configuration in which the piston (53,57), among the cylinder (52,56) and the piston (53,57), moves in eccentric rotation (hereinafter referred to as the "moving-piston configuration"). Here, other than the moving-piston configuration, the eccentric rotation mechanism (24,25) may employ a configuration in which the cylinder (52,56), among the cylinder (52,56) and the piston (53, 57), moves in eccentric rotation (hereinafter referred to as the "fixed-piston configuration").

Here, whether it is a moving-piston configuration or a fixed-piston configuration, one of the cylinder (52,56) and the piston (53,57) of the eccentric rotation mechanism (24,25) that moves in eccentric rotation swings relative to the blade (45). Therefore, there is a swing moment on the member moving in eccentric rotation, and the reaction force against the swing moment vibrates the fluid machine (20).

Note that the swing moment refers to a force acting upon an object that is swinging about a fulcrum like a pendulum, and is expressed as the product of the moment of inertia of the object about the fulcrum and the swing angular acceleration thereof. A reaction force against the swing moment acts upon the fulcrum. The swing moment is greater as the distance between the center of gravity of the swinging member and the swing fulcrum is larger. In the moving-piston configuration, the swing fulcrum moves together with the piston (53,57), and therefore in each eccentric rotation mechanism (24,25), the distance between the center of gravity of the swinging piston (53,57) and the swing fulcrum remains constant. On the other hand, in the fixed-piston configuration, since the swing fulcrum does not move, in each eccentric rotation mechanism (24,25), the distance between the center of gravity of the swinging cylinder (52,56) and the swing fulcrum varies. The fifth aspect of the invention employs the moving-piston configuration where in each eccentric rotation mechanism (24,25), the distance between the center of gravity of the swinging member and the swing fulcrum remains constant.

In the sixth aspect of the invention, the height of the cylinder chamber (54) of the first eccentric rotation mechanism (24) and the height of the cylinder chamber (58) of the second eccentric rotation mechanism (25) differ from each other. In the sixth aspect of the invention, the suction volume ratio is adjusted by the ratio between the heights of the cylinder chambers (54,58).

In the seventh aspect of the invention, the amount of eccentricity of the first eccentric rotation mechanism (24) and the amount of eccentricity of the second eccentric rotation mechanism (25) differ from each other. In the seventh aspect of the invention, the suction volume ratio is adjusted by the ratio between the degrees of eccentricity.

In the eighth aspect of the invention, the partition structure (101,102) forms the high-pressure back pressure chambers (96,97) communicating with a gap surrounding the drive shaft (23) which provides a pressure of fluid discharged from the second eccentric rotation mechanism (25) on the back surface of the movable-side end plate portion (51*a*,52*a*) of the first eccentric rotation mechanism (24) and on the back surface of the movable-side end plate portion (55*a*,56*a*) of the second eccentric rotation mechanism (25). Here, each fluid chamber (63,64) of the second eccentric rotation mechanism (25) serves as a higher-stage fluid chamber in which fluid of an intermediate pressure is compressed to a high pressure. Therefore, the gap surrounding the drive shaft (23) serves as a high-pressure space. In the eighth aspect of the invention, the partition structure (101,102) are used to form the high-pressure back pressure chambers (96,97) to be high-pressure spaces on the back surface of the movable-side end plate portion (51*a*,52*a*) of the first eccentric rotation mechanism (24) and on the back surface of the movable-side end plate portion (55*a*,56*a*) of the second eccentric rotation mechanism (25).

In the ninth aspect of the invention, the first seal ring (101) forms the high-pressure back pressure chamber (96) of the first eccentric rotation mechanism (24) between one surface of the middle plate (41) and the back surface of the movable-side end plate portion (51*a*,52*a*) of the first eccentric rotation mechanism (24). The second seal ring (102) forms the high-pressure back pressure chamber (97) of the second eccentric rotation mechanism (25) between the other surface of the middle plate (41) and the back surface of the movable-side end plate portion (55*a*,56*a*) of the second eccentric rotation mechanism (25).

In the tenth aspect of the invention, the first eccentric direction and the second eccentric direction are shifted from each other by a predetermined angle of 60° or more and 310° or less. That is, the phase difference between the first eccentric portion (23*b*) and the second eccentric portion (23*c*) is a predetermined angle of 60° or more and 310° or less. Here, as shown in FIG. 9, when the phase difference between the first eccentric portion (23*b*) and the second eccentric portion (23*c*) is 60° or more and 310° or less, the torque variation ratio, which is determined based on the torque variation range when the phase difference is 180°, is generally 1.0 or less. In the tenth aspect of the invention, the shift angle between the first eccentric direction and the second eccentric direction is set so that the torque variation ratio is generally 1.0 or less.

In the eleventh aspect of the invention, the first eccentric direction and the second eccentric direction are shifted from each other by 180°. Therefore, the centrifugal load acting upon the first eccentric portion (23*b*) and the centrifugal load acting upon the second eccentric portion (23*c*) act in exactly opposite directions. Therefore, the centrifugal load acting upon the first eccentric portion (23*b*) and the centrifugal load acting upon the second eccentric portion (23*c*) are significantly canceled out by each other.

In the twelfth aspect of the invention, the fluid machine (20) is connected to the refrigerant circuit (10) filled with carbon dioxide. Here, carbon dioxide refrigerant has a greater density than chlorofluorocarbon refrigerant, and a higher speed of sound therethrough. Here, the pressure pulsation caused by the fluid flow rate variation is in proportion to the density of the fluid or the speed of sound therethrough. Therefore, the refrigerant circuit (10) filled with carbon dioxide has a greater pressure pulsation caused by the refrigerant flow rate variation as compared with the refrigerant circuit (10) filled with chlorofluorocarbon refrigerant. In the twelfth aspect of the invention, the fluid machine (20) is connected to the refrigerant circuit (10) having a greater pressure pulsation caused by the refrigerant flow rate variation.

Advantages of the Invention

In an aspect of the present invention, since a lower-stage fluid chamber and a higher-stage fluid chamber are formed in separate eccentric rotation mechanisms (24,25), the suction volume ratio can be adjusted by the ratio between the height of the cylinder chamber (54) of the first eccentric rotation mechanism (24) and the height of the cylinder chamber (58) of the second eccentric rotation mechanism (25) or the ratio between the amount of eccentricity of the first eccentric portion (23*b*) and the amount of eccentricity of the second eccentric portion (23*c*). The ratio of height between the cylinder chambers (54,58) or the ratio of amount of eccentricity therebetween can be easily adjusted. Therefore, the suction volume ratio can be easily set to a predetermined ratio.

In an aspect of the present invention, two fluid chambers (61-64) are farmed in each eccentric rotation mechanism (24,25). In each eccentric rotation mechanism (24,25), the phase of volume change of the outer fluid chamber (61,63) is shifted from the phase of volume change of the inner fluid chamber (62,64) by 180° (see FIG. 3). That is, in each eccentric rotation mechanism (24,25), the phase of pressure variation of the outer fluid chamber (61,63) is shifted from the phase of pressure variation of the inner fluid chamber (62,64). Thus, the torque variation range (the difference between the maximum torque and the minimum torque) for driving each eccentric rotation mechanism (24,25) is smaller as compared with that of a configuration with only one fluid chamber such as a rotary-type eccentric rotation mechanism, for example, as shown in FIG. 7. Thus, it is possible to reduce the vibration of the fluid machine (20).

In the third aspect of the invention, the fluid introduced into the outer fluid chamber (61,63) of each eccentric rotation mechanism (24,25) and the fluid introduced into the inner fluid chamber (62,64) thereof flow through the same passageway, thus reducing the fluid flow rate variation in the inflow passageway (32) and in the communication passageway (33). Here, a passageway through which fluid flows has a pressure pulsation caused by the fluid flow rate variation, and the pressure pulsation causes vibrations. The pressure pulsation is greater as the fluid flow rate variation is greater. In the third aspect of the invention, the fluid flow rate variation is reduced in the inflow passageway (32) and in the communication passageway (33). Therefore, in the inflow passageway (32) and the communication passageway (33), it is possible to reduce the pressure pulsation caused by the fluid flow rate variation, and the variation caused by the pressure pulsation.

In the fourth aspect of the invention, in each eccentric rotation mechanism (24,25), the fluid of the outer fluid chambers (61,63) and the fluid of the inner fluid chambers (62,64) are discharged into the same discharge space (46,47). Here, where in the same eccentric rotation mechanism (24,25), the pressure of the discharged fluid from the outer fluid chamber (61,63) is different from the pressure of the discharged fluid from the inner fluid chamber (62,64), as in a conventional fluid machine, the discharge space for the outer fluid chamber (61,63) and the discharge space for the inner fluid chamber (62,64) are separate from each other. Therefore, the discharge space and the passageway extending from the discharge space will be narrower, thus relatively increasing the pressure loss of the discharged fluid.

In contrast, in the fourth aspect of the invention, in each eccentric rotation mechanism (24,25), the fluid of the outer fluid chambers (61,63) and the fluid of the inner fluid chambers (62,64) are discharged into the same discharge space (46,47), and therefore the discharge space (46,47) is enlarged according to the flow rate of the discharged fluid from two fluid chambers, also enlarging the passageway extending from the discharge space (46,47). Therefore, it is possible to reduce the pressure loss of the discharged fluid.

In the fifth aspect of the invention, each eccentric rotation mechanism (24,25) employs the moving-piston configuration, where the distance between the center of gravity of the swinging member and the swing fulcrum remains constant. Therefore, the difference between the swing moment of the first eccentric rotation mechanism (24) and the swing moment of the second eccentric rotation mechanism (25) does not vary. Therefore, if the phase difference between the crank angle of the first eccentric rotation mechanism (24) and the crank angle of the second eccentric rotation mechanism (25) is set to a value (e.g., 180°) such that the swing moment of the first eccentric rotation mechanism (24) and the swing moment of the second eccentric rotation mechanism (25) are canceled out by each other, the swing moment of the first eccentric rotation mechanism (24) and the swing moment of the second eccentric rotation mechanism (25) are always significantly canceled out by each other, and it is therefore possible to reduce the vibration due to the swing moment.

In the eighth aspect of the invention, the partition structure (101,102) are used to form the high-pressure back pressure chambers (96,97) to be high-pressure spaces on the back surface of the movable-side end plate portion (51*a*,52*a*) of the first eccentric rotation mechanism (24) and on the back surface of the movable-side end plate portion (55*a*,56*a*) of the second eccentric rotation mechanism (25). Here, in the fluid machine (20) where each fluid chamber (61,62) of the first eccentric rotation mechanism (24) serves as a lower-stage fluid chamber and each fluid chamber (63,64) of the second eccentric rotation mechanism (25) serves as a higher-stage fluid chamber, the pressure of the back pressure chamber of each eccentric rotation mechanism (24,25) may be adjusted to the pressure of the discharged fluid from the fluid chamber of the eccentric rotation mechanism (24,25). That is, the back pressure chamber of the first eccentric rotation mechanism (24) may be adjusted to an intermediate pressure, and the back pressure chamber of the second eccentric rotation mechanism (25) may be adjusted to a high pressure. However, where the gap surrounding the drive shaft (23) serves as a high-pressure space, it is necessary to cut off the communication between the back pressure chamber of the first eccentric rotation mechanism (24) and the gap surrounding the drive shaft (23), and it is necessary to partition both the outside and the inside of the back pressure chamber of the first eccentric rotation mechanism (24). In contrast, in the eighth aspect of the invention, since the high-pressure back pressure chamber (96,97) of each eccentric rotation mechanism (24, 25) is adjusted to a high pressure, it is only necessary to partition the outside of the high-pressure back pressure chamber (96,97). Thus, it is possible to simplify the configuration of the partition structure (101,102).

In the ninth aspect of the invention, the high-pressure back pressure chamber (96) of the first eccentric rotation mechanism (24) and the high-pressure back pressure chamber (97) of the second eccentric rotation mechanism (25) are formed by separate seal rings (101,102). Here, in the fluid machine (20) where each fluid chamber (61,62) of the first eccentric rotation mechanism (24) serves as a lower-stage fluid chamber and each fluid chamber (63,64) of the second eccentric rotation mechanism (25) serves as a higher-stage fluid chamber, the force that urges the movable-side end plate portions (55*a*,56*a*) to move away from each other due to the internal pressure of the fluid chambers (61-64) (hereinafter referred to as the "repelling force") is larger in the second eccentric rotation mechanism (25) where each fluid chamber (63,64) serves as a higher-stage fluid chamber as compared with that in the first eccentric rotation mechanism (24) where each fluid chamber (61,62) serves as a lower-stage fluid chamber. Therefore, where the high-pressure back pressure chamber (96) of the first eccentric rotation mechanism (24) and the high-pressure back pressure chamber (97) of the second eccentric rotation mechanism (25) are formed by the same seal ring, the size of the seal ring is set so that the movable-side end plate portions (55*a*,56*a*) of the second eccentric rotation mechanism (25), where the repelling force is larger, do not move away from each other, and therefore the force by which the high-pressure back pressure chamber (96) presses the movable-side end plate portions (51*a*,52*a*) against each other (hereinafter referred to as the "pressing force") in the first eccentric rotation mechanism (24), where the repelling force is smaller, is excessive with respect to the repelling force.

In contrast, in the ninth aspect of the invention, since the high-pressure back pressure chamber (96) of the first eccentric rotation mechanism (24) and the high-pressure back pressure chamber (97) of the second eccentric rotation mechanism (25) are formed by separate seal rings (101,102), the area of the high-pressure back pressure chamber (96) of the first eccentric rotation mechanism (24) and the area of the high-pressure back pressure chamber (97) of the second eccentric rotation mechanism (25) can each be set according to the repelling force. Therefore, in the first eccentric rotation mechanism (24), where the repelling force is smaller, it is possible to prevent the pressing force from becoming excessive with respect to the repelling force, and it is therefore possible to reduce the friction loss of the first eccentric rotation mechanism (24).

In the tenth aspect of the invention, the shift angle between the first eccentric direction and the second eccentric direction is set so that the torque variation ratio is 1.0 or less. Therefore, it is possible to produce the fluid machine (20) with low vibrations.

In the eleventh aspect of the invention, since the first eccentric direction and the second eccentric direction are shifted from each other by 180°, the centrifugal load acting upon the first eccentric portion (23*b*) and the centrifugal load acting upon the second eccentric portion (23*c*) are significantly canceled out by each other. Therefore, it is possible to significantly reduce the vibration due to the centrifugal load.

In the twelfth aspect of the invention, the fluid machine (20) is connected to the refrigerant circuit (10) with a large pressure pulsation caused by the refrigerant flow rate variation. Therefore, there is a greater advantage of reducing the pressure pulsation with such a configuration where the fluid introduced into the outer fluid chamber (61) of the first eccentric rotation mechanism (24) and the fluid introduced into the inner fluid chamber (62) thereof flow through the same passageway, and the fluid introduced into the outer fluid chamber (63) of the second eccentric rotation mechanism (25) and the fluid introduced into the inner fluid chamber (64) thereof flow through the same passageway, as in the third aspect of the invention, so as to reduce the pressure pulsation caused by the refrigerant flow rate variation.

DESCRIPTION OF EMBODIMENTS

Embodiments of the present invention will now be described in detail with reference to the drawings. Note however that Reference Embodiment to be a reference of the present invention will be first described with reference to the drawings, followed by embodiments of the present invention.

Reference Embodiment

Reference Embodiment to be a reference of the present invention will now be described with reference to the drawings.

A refrigerator of Reference Embodiment is an air conditioner (1) including a fluid machine (20) to be a reference of the present invention for selectively heating or cooling the room. The air conditioner (1) includes a refrigerant circuit (10) in which refrigerant circulates to perform a refrigeration cycle, and forms a so-called heat pump-type air conditioner. The refrigerant circuit (10) is filled with carbon dioxide as refrigerant.

Figure 10:
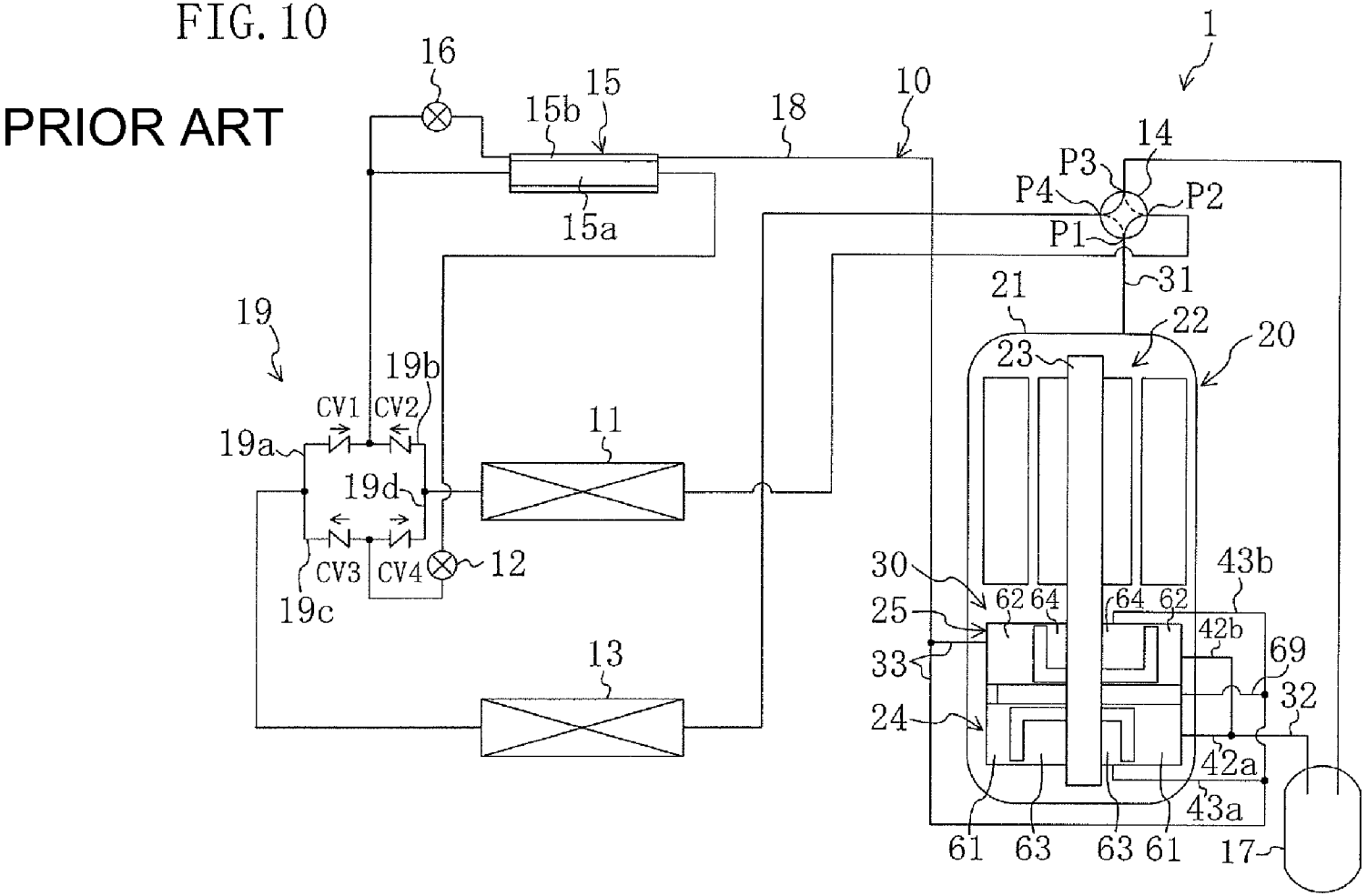
FIG. 10 PRIOR ART
FIG. 10 is a piping diagram showing a refrigerant circuit of an air conditioner according to Reference Embodiment.

As shown in FIG. 10, the refrigerant circuit (10) includes a compressor (20), an indoor heat exchanger (11), an expansion valve (12) and an outdoor heat exchanger (13), as main components.

The indoor heat exchanger (11) is provided in an indoor unit. The indoor heat exchanger (11) exchanges heat between the indoor air blown by an indoor fan (not shown) and the refrigerant. On the other hand, the outdoor heat exchanger (13) is provided in an outdoor unit. The outdoor heat exchanger (13) exchanges heat between the outdoor air blown by an outdoor fan (not shown) and the refrigerant. The expansion valve (12) is provided between an internal heat exchanger (15) to be described later and the second end of a bridge circuit (19) to be described later. The expansion valve (12) is formed by an electronic expansion valve whose degree of opening can be adjusted.

The refrigerant circuit (10) includes a four-way switching valve (14), the bridge circuit (19), the internal heat exchanger (15), a pressure reducing valve (16), and a receiver (17).

The four-way switching valve (14) includes four, first to fourth, ports. The first port of the four-way switching valve (14) is connected to a discharge pipe (31) of the compressor (20), the second port thereof to the indoor heat exchanger (11), the third port thereof to a suction pipe (32) of the compressor (20) via the receiver (17), and the fourth port thereof to the outdoor heat exchanger (13). The four-way switching valve (14) is configured so that it can be switched between a first state (the state denoted by a solid line in FIG. 10) where a first port (P1) and a second port (P2) communicate with each other while a third port (P3) and a fourth port (P4) communicate with each other, and a second state (the state denoted by a broken line in FIG. 10) where the first port (P1) and the fourth port (P4) communicate with each other while the second port (P2) and the third port (P3) communicate with each other.

The bridge circuit (19) is a circuit in which a first connection line (19*a*), a second connection line (19*b*), a third connection line (19*c*) and a fourth connection line (19*d*) are connected together in a bridge connection. The first connection line (19*a*) connects the outdoor heat exchanger (13) with a first end of the internal heat exchanger (15). The second connection line (19*b*) connects the indoor heat exchanger (11) with the first end of the internal heat exchanger (15). The third connection line (19*c*) connects the outdoor heat exchanger (13) with a second end of the internal heat exchanger (15). The fourth connection line (19*d*) connects the indoor heat exchanger (11) with the second end of the internal heat exchanger (15).

The first connection line (19*a*) includes a first check valve (CV1) for preventing the refrigerant flow from the first end of the internal heat exchanger (15) toward the outdoor heat exchanger (13). The second connection line (19*b*) includes a second check valve (CV2) for preventing the refrigerant flow from the first end of the internal heat exchanger (15) toward the indoor heat exchanger (11). The third connection line (19*c*) includes a third check valve (CV3) for preventing the refrigerant flow from the outdoor heat exchanger (13) toward the second end of the internal heat exchanger (15). The fourth connection line (19*d*) includes a fourth check valve (CV4) for preventing the refrigerant flow from the indoor heat exchanger (11) toward the second end of the internal heat exchanger (15).

The internal heat exchanger (15) is a double-pipe heat exchanger including a first heat exchange passageway (15*a*) and a second heat exchange passageway (15*b*). The first heat exchange passageway (15*a*) is arranged so as to lie along a refrigerant pipe that connects a first end of the bridge circuit (19), at which the exit end of the first connection line (19*a*) and the exit end of the second connection line (19*b*) are connected together, with a second end of the bridge circuit (19), at which the entrance end of the third connection line (19*c*) and the entrance end of the fourth connection line (19*d*) are connected together. The second heat exchange passageway (15*b*) is arranged so as to lie along an intermediate injection pipe (18) that branches off from between the internal heat exchanger (15) and the first end of the bridge circuit (19). The intermediate injection pipe (18) forms an intermediate injection passageway, and is connected to an intermediate-pressure communication pipe (33) to be described later. The intermediate injection pipe (18) includes the pressure reducing valve (16) forming an open/close mechanism upstream of the internal heat exchanger (15). Then, in the internal heat exchanger (15), heat can be exchanged between high-pressure liquid refrigerant flowing through the first heat exchange passageway (15*a*) and intermediate-pressure refrigerant flowing through the second heat exchange passageway (15*b*).

In Reference Embodiment, the compressor (20) is formed as a compressor for carbon dioxide refrigerant. The compressor (20) includes a compression mechanism (30) formed by a first mechanism portion (24) and a second mechanism portion (25). The mechanism portion (24,25) includes a lower-stage compression chamber (61,62) and a higher-stage compression chamber (63,64). Note that the details of the inside of the compressor (20) will be described later.

A plurality of pipes are connected to the compressor (20). Specifically, a first suction branch pipe (42*a*) diverging from the suction pipe (32) is connected to the suction side of a lower-stage compression chamber (61) of the first mechanism portion (24). A second suction branch pipe (42*b*) diverging from the suction pipe (32) is connected to the suction side of a lower-stage compression chamber (62) of the second mechanism portion (25). The intermediate-pressure communication pipe (33) is connected to the discharge side of the lower-stage compression chamber (61) of the second mechanism portion (25). In the compressor (20), the discharge side of the lower-stage compression chamber (62) of the second mechanism portion (25) communicates with the discharge side of the lower-stage compression chamber (61) of the first mechanism portion (24). A first intermediate branch pipe (43*a*) diverging from the intermediate-pressure communication pipe (33) is connected to the suction side of a higher-stage compression chamber (63) of the first mechanism portion (24). A second intermediate branch pipe (43*b*) diverging from the intermediate-pressure communication pipe (33) is connected to the suction side of a higher-stage compression chamber (64) of the second mechanism portion (25). A connection pipe (69) connected to an intermediate connection passageway (79) to be described later is diverging from the second intermediate branch pipe (43*b*).

<Configuration of Compressor>

Figure 11:
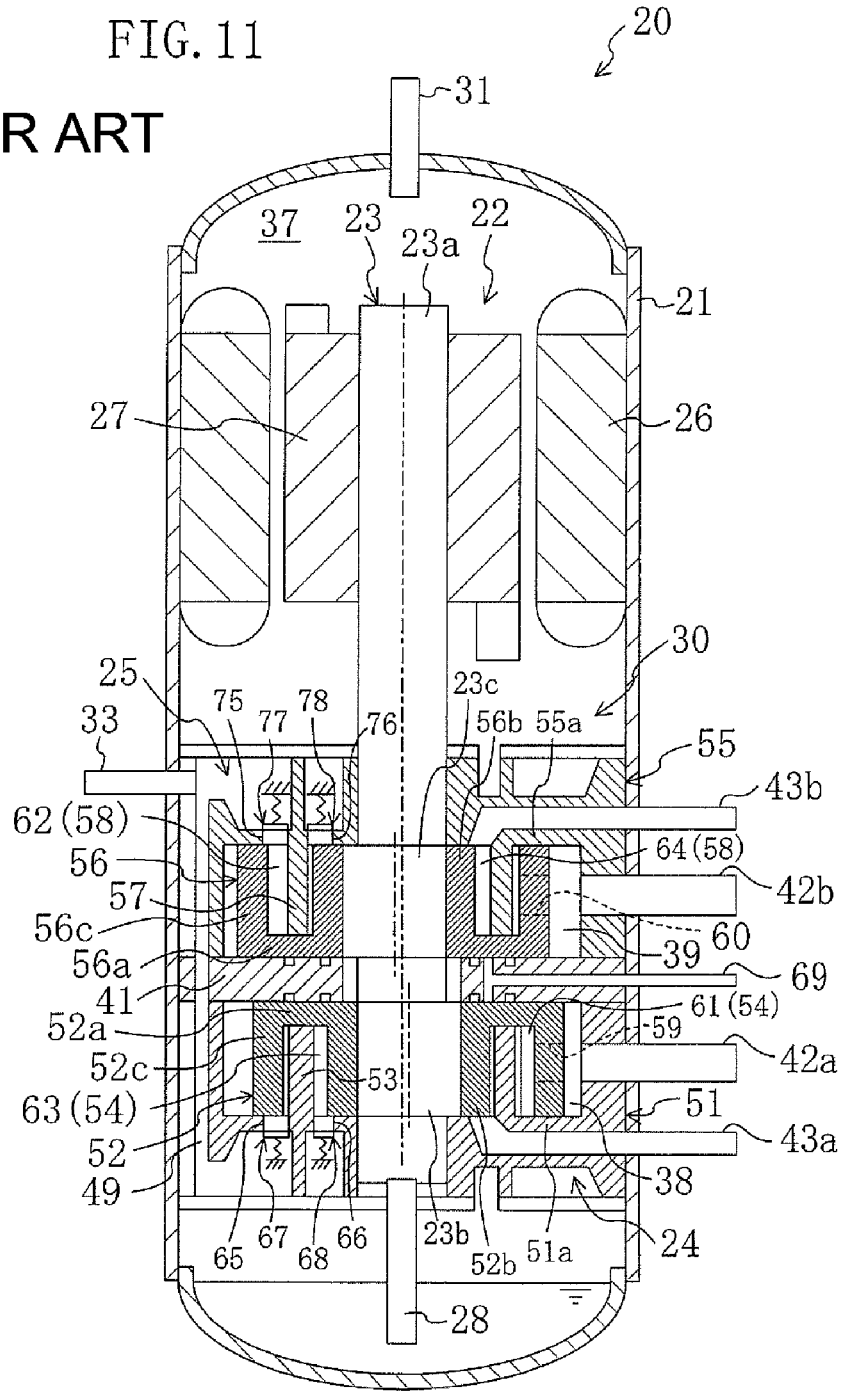
FIG. 11 PRIOR ART
FIG. 11 is a vertical cross-sectional view showing a compressor according to Reference Embodiment.

As shown in FIG. 11, the compressor (20) includes a casing (21), which is a vertically-elongated, hermetic container. A motor (22) and the compression mechanism (30) are accommodated in the casing (21). The compressor (20) is formed by a so-called high pressure dome-type compressor, where the casing (21) is filled with a high-pressure refrigerant.

The motor (22) includes a stator (26) and a rotor (27). The stator (26) is fixed to the body portion of the casing (21). On the other hand, the rotor (27) is arranged on the inner side of the stator (26), and is coupled to a main shaft portion (23*a*) of a drive shaft (23). Note that the rotation speed of the motor (22) can be varied by an inverter control. That is, the motor (22) is formed by an inverter-type compressor whose capacity can be varied.

The drive shaft (23) includes a first eccentric portion (23*b*) located near the lower portion thereof, and a second eccentric portion (23*c*) located near the central portion thereof. The first eccentric portion (23*b*) and the second eccentric portion (23*c*) are each eccentric with the axis of the main shaft portion (23*a*) of the drive shaft (23). The first eccentric portion (23*b*) and the second eccentric portion (23*c*) have their phases shifted by 180° from each other about the axis of the drive shaft (23).

The compression mechanism (30) is arranged under the motor (22). The compression mechanism (30) includes the first mechanism portion (24) near the bottom portion of the casing (21), and the second mechanism portion (25) near the motor (22).

The first mechanism portion (24) includes a first housing (51) fixed to the casing (21), and a first cylinder (52) accommodated in the first housing (51). The first housing (51) forms a fixed member, and the first cylinder (52) forms a movable member.

The first housing (51) includes a disc-shaped fixed-side end plate portion (51*a*), and an annular first piston (53) protruding upwardly from the upper surface of the fixed-side end plate portion (51*a*). On the other hand, the first cylinder (52) includes a disc-shaped movable-side end plate portion (52*a*), an annular inner cylinder portion (52*b*) protruding downwardly from the inner periphery edge portion of the movable-side end plate portion (52*a*), and an annular outer cylinder portion (52*c*) protruding downwardly from the outer periphery edge portion of the movable-side end plate portion (52*a*). The first eccentric portion (23*b*) is fitted in the inner cylinder portion (52*b*) of the first cylinder (52). The first cylinder (52) is configured so as to rotate in eccentric rotation about the axis of the main shaft portion (23*a*) in response to the rotation of the drive shaft (23).

The first cylinder (52) includes an annular first cylinder chamber (54) formed between the outer circumferential surface of the inner cylinder portion (52*b*) and the inner circumferential surface of the outer cylinder portion (52*c*). The first piston (53) is arranged in the first cylinder chamber (54). As a result, the first cylinder chamber (54) is divided into the first lower-stage compression chamber (61) formed between the outer circumferential surface of the first piston (53) and the outer wall of the first cylinder chamber (54), and the first higher-stage compression chamber (63) formed between the inner circumferential surface of the first piston (53) and the inner wall of the first cylinder chamber (54). The outer cylinder portion (52*c*) of the first cylinder (52) includes a first communication passageway (59) for the communication between a suction space (38) on the outer side of the first cylinder (52) and the first lower-stage compression chamber (61).

Figure 12:
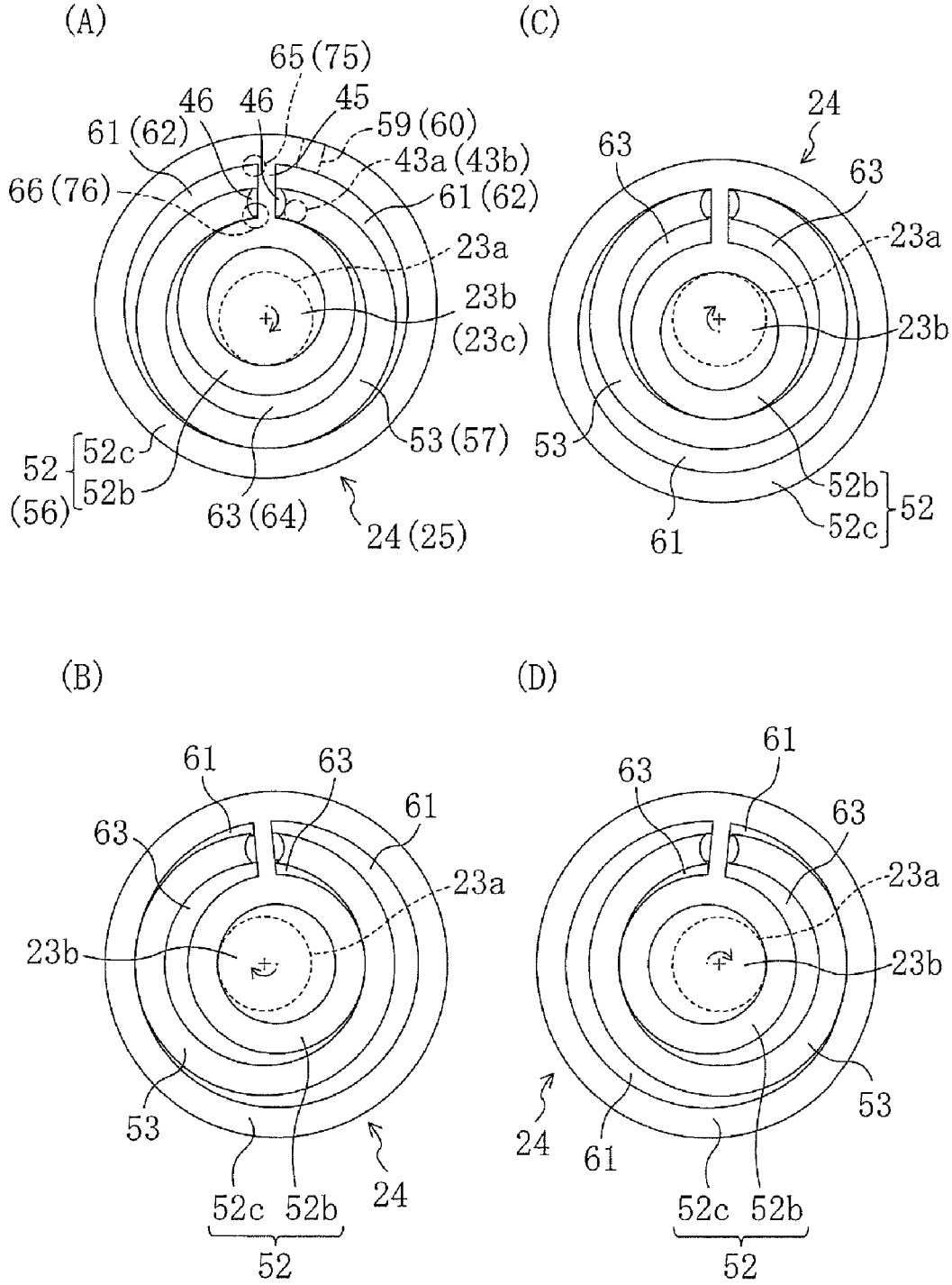
FIG. 12 PRIOR ART
FIG. 12 is a lateral cross-sectional view showing a first mechanism portion (second mechanism portion) according to Reference Embodiment.

As shown in FIG. 12, the first cylinder (52) includes a blade (45) extending from the inner circumferential surface of the outer cylinder portion (52*c*) to the outer circumferential surface of the inner cylinder portion (52*b*). The blade (45) is integral with the first cylinder (52). Note that for each member denoted also by a reference character in parentheses in FIG. 12, a reference character not in parentheses is for the first mechanism portion (24), and a reference character in parentheses is for the second mechanism portion (25). This similarly applies to FIGS. 3 and 5.

The blade (45) divides each of the first lower-stage compression chamber (61) and the first higher-stage compression chamber (63) into a low-pressure chamber to be the suction side and a high-pressure chamber to be the discharge side. On the other hand, the first piston (53) has a C-letter shape in which an annular shape is partially broken, and the blade (45) is inserted in the broken portion. Semicircular bushes (46,46) are fitted to the broken portions of the piston (53) with the blade (45) interposed therebetween. The bushes (46,46) are configured so that they can swing at the end portion of the piston (53). With such a configuration, a cylinder (52) can reciprocate in the direction in which the blade (45) extends, and can swing along with the bushes (46,46). As the drive shaft (23) rotates, the cylinder (52) rotates in eccentric rotation as sequentially shown in (A)-(D) of FIG. 12, and refrigerant is compressed in the first lower-stage compression chamber (61) and the first higher-stage compression chamber (63).

The second mechanism portion (25) is formed by the same mechanical components as those of the first mechanism portion (24). The second mechanism portion (25) is upside down with respect to the first mechanism portion (24) with a middle plate (41) interposed therebetween.

Specifically, the second mechanism portion (25) includes a second housing (55) fixed to the casing (21), and a second cylinder (56) accommodated in the second housing (55). The second housing (55) forms a fixed member, and the second cylinder (56) forms a movable member.

The second housing (55) includes a disc-shaped fixed-side end plate portion (55*a*), and an annular second piston (57) protruding downwardly from the lower surface of the fixed-side end plate portion (55*a*). On the other hand, the second cylinder (56) includes a disc-shaped end plate portion (56*a*), an annular inner cylinder portion (56*b*) protruding upwardly from the inner periphery edge portion of the end plate portion (56*a*), and an annular outer cylinder portion (56*c*) protruding upwardly from the outer periphery edge portion of the end plate portion (56*a*). The second eccentric portion (23*c*) is fitted in the inner cylinder portion (56*b*) of the second cylinder (56). The second cylinder (56) is configured so as to rotate in eccentric rotation about the axis of the main shaft portion (23*a*) in response to the rotation of the drive shaft (23).

The second cylinder (56) includes an annular second cylinder chamber (58) formed between the outer circumferential surface of the inner cylinder portion (56*b*) and the inner circumferential surface of the outer cylinder portion (56*c*). The second piston (57) is arranged in the second cylinder chamber (58). As a result, the second cylinder chamber (58) is divided into the second lower-stage compression chamber (62) formed between the outer circumferential surface of the second piston (57) and the outer wall of the second cylinder chamber (58), and the second higher-stage compression chamber (64) formed between the inner circumferential surface of the second piston (57) and the inner wall of the second cylinder chamber (58). The outer cylinder portion (56*c*) of the second cylinder (56) includes a second communication passageway (60) for the communication between the suction space (39) on the outer side of the second cylinder (56) and the second lower-stage compression chamber (62).

In the second mechanism portion (25), the second cylinder (56) rotates in eccentric rotation as the drive shaft (23) rotates, as in the first mechanism portion (24). As a result, refrigerant is compressed in the second lower-stage compression chamber (62) and the second higher-stage compression chamber (64).

Note that the mechanism portions of the first mechanism portion (24) and the second mechanism portion (25) are designed so that the suction volume ratio of the higher-stage compression chamber (63,64) with respect to the lower-stage compression chamber (61,62) is a value in the range of 0.8-1.3 (e.g., 1.0).

The discharge pipe (31), the first suction branch pipe (42*a*), the second suction branch pipe (42*b*), the intermediate-pressure communication pipe (33), the first intermediate branch pipe (43*a*), and the second intermediate branch pipe (43*b*) are passing through the casing (21). The discharge pipe (31) passes through the top portion of the casing (21), and the other pipes (42,43) are passing through the body portion thereof. The discharge pipe (31) is opened into an inner space (37) which is to be a high-pressure space when the compressor (20) is in operation.

The first suction branch pipe (42*a*) and the first intermediate branch pipe (43*a*) are connected to the first mechanism portion (24). The first suction branch pipe (42*a*) is connected to the suction side of the first lower-stage compression chamber (61) via the first communication passageway (59). The discharge side of the first lower-stage compression chamber (61) is connected to the discharge side of the second lower-stage compression chamber (62) via a communication passageway (49), which is formed to extend across the first housing (51), the middle plate (41) and the second housing (55). The first intermediate branch pipe (43*a*) is connected to the suction side of the first higher-stage compression chamber (63). Note that the discharge side of the first higher-stage compression chamber (63) is connected to the inner space (37) through a communication passageway (not shown).

The first mechanism portion (24) includes an outer discharge port (65) and an inner discharge port (66) formed in the first housing (51). The outer discharge port (65) communicates the discharge side of the first lower-stage compression chamber (61) with the communication passageway (49). A first discharge valve (67) is provided at the outer discharge port (65). The first discharge valve (67) is configured so as to open the outer discharge port (65) when the refrigerant pressure on the discharge side of the first lower-stage compression chamber (61) becomes greater than or equal to the refrigerant pressure on the side of the communication passageway (49). On the other hand, the inner discharge port (66) communicates the discharge side of the first higher-stage compression chamber (63) with the inner space (37). A second discharge valve (68) is provided at the inner discharge port (66). The second discharge valve (68) is configured so as to open the inner discharge port (66) when the refrigerant pressure on the discharge side of the first higher-stage compression chamber (63) becomes greater than or equal to the refrigerant pressure of the inner space (37) of the casing (21).

The second suction branch pipe (42*b*), the intermediate-pressure communication pipe (33) and the second intermediate branch pipe (43*b*) are connected to the second mechanism portion (25). The second suction branch pipe (42*b*) is connected to the suction side of the second lower-stage compression chamber (62) via the second communication passageway (60). The intermediate-pressure communication pipe (33) is connected to the discharge side of the second lower-stage compression chamber (62). The second intermediate branch pipe (43*b*) is connected to the suction side of the second higher-stage compression chamber (64). Note that the discharge side of the second higher-stage compression chamber (64) is connected to the inner space (37) through a communication passageway (not shown).

As does the first mechanism portion (24), the second mechanism portion (25) includes an outer discharge port (75) and an inner discharge port (76) formed in the second housing (55). The outer discharge port (75) communicates the discharge side of the second lower-stage compression chamber (62) with the intermediate-pressure communication pipe (33). A third discharge valve (77) is provided at the outer discharge port (75). The third discharge valve (77) is configured so as to open the outer discharge port (75) when the refrigerant pressure on the discharge side of the second lower-stage compression chamber (62) becomes greater than or equal to the refrigerant pressure on the side of the intermediate-pressure communication pipe (33). On the other hand, the inner discharge port (76) communicates the discharge side of the second higher-stage compression chamber (64) with the inner space (37) of the casing (21). A fourth discharge valve (78) is provided at the inner discharge port (76). The fourth discharge valve (78) is configured so as to open the inner discharge port (76) when the refrigerant pressure on the discharge side of the second higher-stage compression chamber (64) becomes greater than or equal to the refrigerant pressure of the inner space (37) of the casing (21).

An oil reservoir for storing refrigerator oil is formed in a bottom portion of the casing (21). An oil pump (28) immersed in the oil reservoir is provided at the lower end of the drive shaft (23). An oil supply passageway (not shown) is formed inside the drive shaft (23), and refrigerator oil sucked up by the oil pump (28) passes through the oil supply passageway. In the compressor (20), in response to the rotation of the drive shaft (23), the refrigerator oil sucked up by the oil pump (28) passes through the oil supply passageway to be supplied to the sliding portions of the mechanism portions (24,25) and the bearing portion of the drive shaft (23).

Figure 13:
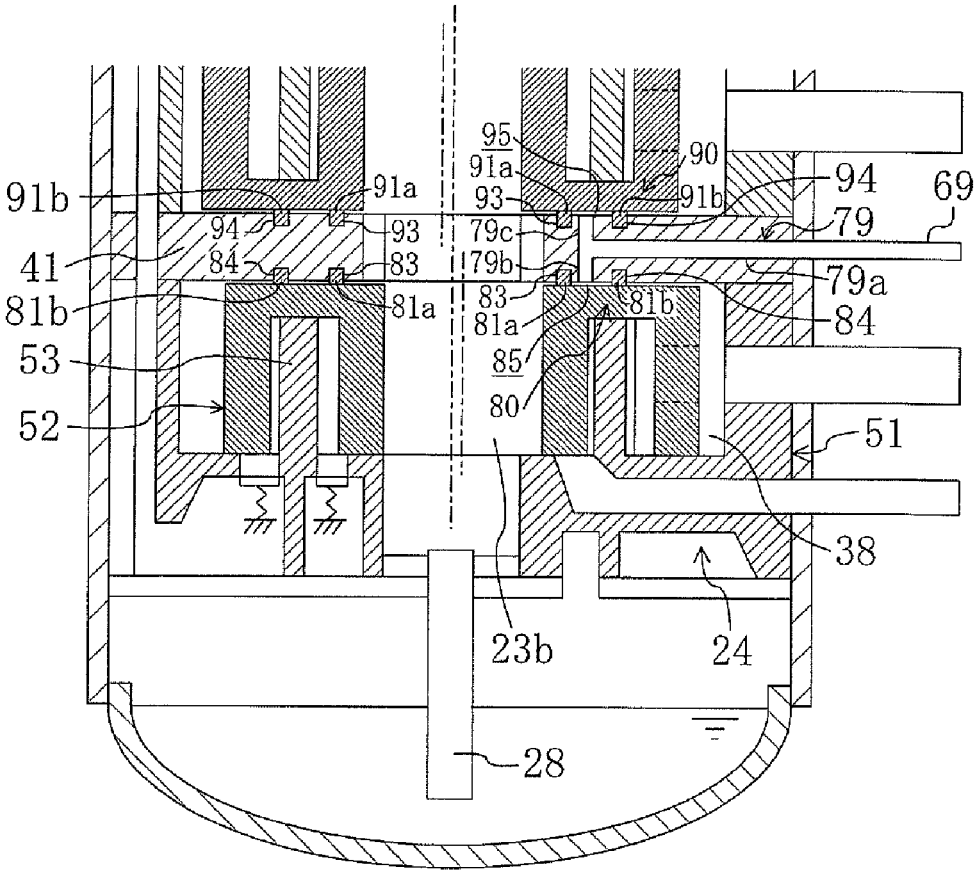
PRIOR ART FIG. 13
FIG. 13 is an enlarged cross-sectional view showing a pressing mechanism according to Reference Embodiment.

In Reference Embodiment, the middle plate (41) includes the pressing mechanisms (80,90) as shown in FIG. 13. The pressing mechanisms (80,90) include the first pressing portion (80) provided for the first mechanism portion (24), and the second pressing portion (90) provided for the second mechanism portion (25).

The first pressing portion (80) is configured so as to press the first cylinder (52) against the first housing (51). The first pressing portion (80) includes a first inner seal ring (81*a*) and a first outer seal ring (81*b*), which together form a first intermediate-pressure back pressure chamber (85), and includes the intermediate connection passageway (79) formed in the middle plate (41). The first inner seal ring (81*a*) and the first outer seal ring (81*b*) form partition members.

The first inner seal ring (81*a*) is fitted into a first inner annular groove (83) formed on the lower surface of the middle plate (41) so as to surround the insertion hole of the middle plate (41) through which the drive shaft (23) is inserted. On the other hand, the first outer seal ring (81*b*) is fitted into a first outer annular groove (84) formed on the lower surface of the middle plate (41) so as to surround the first inner annular groove (83). The first inner annular groove (83) and the first outer annular groove (84) are arranged concentric with each other. The first intermediate-pressure back pressure chamber (85) is formed between the lower surface of the middle plate (41) and the upper surface of the first cylinder (52), and between the outer circumference of the first inner annular groove (83) and the inner circumference of the first outer annular groove (84).

One end of the intermediate connection passageway (79) is opened at the outer circumferential surface of the middle plate (41), and the intermediate connection passageway (79) is connected to the connection pipe (69) at that end. The intermediate connection passageway (79) includes a main passageway (79*a*) extending inwardly from the outer circumferential surface of the middle plate (41), a first branch passageway (79*b*) diverging downwardly at the inner end of the main passageway (79*a*), and a second branch passageway (79*c*) diverging upwardly at the inner end of the main passageway (79*a*). The first branch passageway (79*b*) is opened at the lower surface of the middle plate (41) into the first intermediate-pressure back pressure chamber (85). The second branch passageway (79*c*) is opened at the upper surface of the middle plate (41) into a second intermediate-pressure back pressure chamber (95) to be described later.

The first intermediate-pressure back pressure chamber (85) communicates with the connection pipe (69) via the first branch passageway (79*b*) and the main passageway (79*a*). Therefore, the intermediate-pressure refrigerant flowing toward the second higher-stage compression chamber (64) is introduced into the first intermediate-pressure back pressure chamber (85). High-pressure refrigerator oil from the side of the drive shaft (23) is introduced into the inner side of the first inner seal ring (81*a*). The outer side of the first outer seal ring (81*b*) communicates with the suction space (38). The first pressing portion (80) is configured so as to press the first cylinder (52) against the first housing (51) by the high-pressure refrigerator oil on the inner side of the first inner seal ring (81*a*), the intermediate-pressure refrigerant in the first intermediate-pressure back pressure chamber (85), and the low-pressure refrigerant on the outer side of the first outer seal ring (81*b*).

The second pressing portion (90) is configured so as to press the second cylinder (56) against the second housing (55). The second pressing portion (90) includes a second inner seal ring (91*a*) and a second outer seal ring (91*b*), which together form the second intermediate-pressure back pressure chamber (95), and includes the intermediate connection passageway (79). The second inner seal ring (91*a*) and the second outer seal ring (91*b*) form partition members. The first pressing portion (80) and the second pressing portion (90) of the pressing mechanisms (80,90) share the main passageway (79*a*) of the intermediate connection passageway (79).

The second inner seal ring (91*a*) is fitted into a second inner annular groove (93) formed on the upper surface of the middle plate (41) so as to surround the insertion hole of the middle plate (41). On the other hand, the second outer seal ring (91*b*) is fitted into a second outer annular groove (94) formed on the upper surface of the middle plate (41) so as to surround the second inner annular groove (93). The second inner annular groove (93) and the second outer annular groove (94) are arranged concentric with each other. The second intermediate-pressure back pressure chamber (95) is formed between the upper surface of the middle plate (41) and the lower surface of the second cylinder (56), and between the outer circumference of the second inner annular groove (93) and the inner circumference of the second outer annular groove (94).

The second intermediate-pressure back pressure chamber (95) communicates with the connection pipe (69) via the second branch passageway (79*c*) and the main passageway (79*a*). Therefore, the intermediate-pressure refrigerant flowing toward the second higher-stage compression chamber (64) is introduced into the second intermediate-pressure back pressure chamber (95). High-pressure refrigerator oil from the side of the drive shaft (23) is introduced into the inner side of the second inner seal ring (91*a*). The outer side of the second outer seal ring (91*b*) communicates with the suction space (39). The second pressing portion (90) is configured so as to press the second cylinder (56) against the second housing (55) by the high-pressure refrigerator oil on the inner side of the second inner seal ring (91*a*), the intermediate-pressure refrigerant in the second intermediate-pressure back pressure chamber (95), and the low-pressure refrigerant on the outer side of the second outer seal ring (91*b*).

With such a configuration, in the compressor (20) of Reference Embodiment, the cylinders (52,56) of the mechanism portions (24,25) move in eccentric rotation relative to the pistons (53,57) in response to the rotation of the drive shaft (23). As a result, volumes of the compression chambers (61-64) of the first mechanism portion (24) and the second mechanism portion (25) change periodically, thereby compressing the refrigerant in the compression chambers (61-64) of the first mechanism portion (24) and the second mechanism portion (25).

—Operation—

Next, an operation of the air conditioner (1) according to Reference Embodiment will be described. The air conditioner (1) is capable of selectively performing a heating operation and a cooling operation to be described below.

(Heating Operation)

In the heating operation of the air conditioner (1), the four-way switching valve (14) is set to the first state, and the degree of opening of the expansion valve (12) is adjusted appropriately. If the compressor (20) is operated in this state, the refrigerant circuit (10) performs a refrigeration cycle in which the indoor heat exchanger (11) serves as a radiator and the outdoor heat exchanger (13) as an evaporator. Note that the air conditioner (1) performs a super critical refrigeration cycle where the high pressure of the refrigeration cycle is higher than the critical pressure of carbon dioxide refrigerant. This similarly applies to the cooling operation to be described below.

Note that where a relatively larger heating capacity is required, the pressure reducing valve (16) is set to an open state in the air conditioner (1). When the pressure reducing valve (16) is set to an open state, an intermediate injection operation is performed where the intermediate-pressure refrigerant of the refrigeration cycle is injected into the higher-stage compression chambers (63,64) of the mechanism portions (24,25) of the compressor (20) through the intermediate injection pipe (18). While the intermediate injection operation is performed, the degree of opening of the pressure reducing valve (16) is adjusted appropriately. On the other hand, where a relatively low heating capacity is required, the pressure reducing valve (16) is set to a closed state, and the intermediate injection operation is stopped.

First, the flow of the refrigerant during a period in which the intermediate injection operation is not performed will be described. The high-pressure refrigerant discharged from the discharge pipe (31) of the compressor (20) flows through the indoor heat exchanger (11) via the four-way switching valve (14). In the indoor heat exchanger (11), the refrigerant radiates heat to the indoor air. As a result, the room is heated.

The refrigerant which has been cooled by the indoor heat exchanger (11) flows through the first heat exchange passageway (15*a*) of the internal heat exchanger (15), and depressurized to a low pressure through the expansion valve (12), and then flows through the outdoor heat exchanger (13). In the outdoor heat exchanger (13), the refrigerant absorbs heat from the outdoor air to evaporate. The refrigerant which has evaporated through the outdoor heat exchanger (13) is passed to the suction side of the compressor (20) via the receiver (17).

The refrigerant which has flown to the suction side of the compressor (20) branches off to the first suction branch pipe (42*a*) and to the second suction branch pipe (42*b*). The refrigerant which has flown into the first suction branch pipe (42*a*) is compressed in the first lower-stage compression chamber (61) of the first mechanism portion (24). The refrigerant which has flown into the second suction branch pipe (42*b*) is compressed in the second lower-stage compression chamber (62) of the second mechanism portion (25). The refrigerant which has been compressed in the lower-stage compression chambers (61,62) merges together to flow through the intermediate-pressure communication pipe (33) and then branches off into the first intermediate branch pipe (43*a*) and into the second intermediate branch pipe (43*b*). The refrigerant which has flown into the first intermediate branch pipe (43*a*) is compressed in the first higher-stage compression chamber (63) of the first mechanism portion (24). The refrigerant which has flown into the second intermediate branch pipe (43*b*) is compressed in the second higher-stage compression chamber (64) of the second mechanism portion (25). The refrigerant which has been compressed in the higher-stage compression chambers (63,64) both flows into the inner space (37) of the casing (21) and is discharged from the discharge pipe (31).

Next, the flow of the refrigerant during a period in which the intermediate injection operation is performed will be described. What is different from during a period in which the intermediate injection operation is not performed will be described below. During a period in which the intermediate injection operation is performed, a part of the refrigerant which has been cooled through the indoor heat exchanger (11) is depressurized to an intermediate pressure through the pressure reducing valve (16), and then flows into the second heat exchange passageway (15*b*). Thus, in the internal heat exchanger (15), high-pressure refrigerant flows through the first heat exchange passageway (15*a*), and intermediate-pressure refrigerant flows through the second heat exchange passageway (15*b*). In the internal heat exchanger (15), heat of the refrigerant on the side of the first heat exchange passageway (15*a*) is given to the refrigerant on the side of the second heat exchange passageway (15*b*), thereby evaporating the refrigerant on the side of the second heat exchange passageway (15*b*). The refrigerant which has evaporated through the second heat exchange passageway (15*b*) merges with the refrigerant which has been compressed in the lower-stage compression chambers (61,62) to be compressed in the higher-stage compression chambers (63,64).

In Reference Embodiment, the pressing portion (80,90) provided for the mechanism portion (24,25) includes a seal ring (81,91) which forms the intermediate-pressure back pressure chamber (85,95) on the back side of the movable-side end plate portion (52*a*,56*a*). The cylinder (52,56) of the mechanism portion (24,25) is pressed against the housing (51,55) by the pressure of the intermediate-pressure refrigerant in the intermediate-pressure back pressure chamber (85, 95). Here, the pressure of the intermediate-pressure refrigerant is lower during a period in which the intermediate injection operation is not performed as compared with that during a period in which the intermediate injection operation is performed. Therefore, the pressing force of the pressing portion (80,90) is lower during a period in which the intermediate injection operation is not performed as compared with that during a period in which the intermediate injection operation is performed. On the other hand, the repelling force acting between the cylinders (52,56) is smaller during a period in which the intermediate injection operation is not performed as compared with that during a period in which the intermediate injection operation is performed. In Reference Embodiment, the seal ring (81,91) is provided on the back side of the movable-side end plate portion (52*a*,56*a*) of the mechanism portion (24,25) so that the pressing force of the pressing mechanism (80,90) is made small during a period in which the intermediate injection operation is not performed during which the repelling force acting between the movable members (52,56) is small.

(Cooling Operation)

In a cooling operation of the air conditioner (1), the four-way switching valve (14) is set to the second state, and the degree of opening of the expansion valve (12) is adjusted appropriately. When the compressor (20) is operated in this state, the refrigerant circuit (10) performs a refrigeration cycle in which the outdoor heat exchanger (13) serves as a radiator and the indoor heat exchanger (11) as an evaporator. Note that while the injection operation can be performed during the cooling operation, as in the heating operation, only the operation while the injection operation is stopped will be described below.

Specifically, high-pressure refrigerant discharged from the discharge pipe (31) of the compressor (20) flows through the outdoor heat exchanger (13) via the four-way switching valve (14). In the outdoor heat exchanger (13), the refrigerant radiates heat to the outdoor air. The refrigerant which has been cooled through the outdoor heat exchanger (13) is depressurized to a low pressure through the expansion valve (12), and then flows through the indoor heat exchanger (11). In the indoor heat exchanger (11), the refrigerant absorbs heat from the indoor air to evaporate. As a result, the room is cooled. The refrigerant which has evaporated through the indoor heat exchanger (11) is passed to the suction side of the compressor (20) via the receiver (17).

As in the cooling operation, the compressor (20) compresses refrigerant in two-stage compression in the first mechanism portion (24) and in the second mechanism portion (25). The refrigerant which has been compressed in the mechanism portion (24,25) is discharged again from the discharge pipe (31).

Advantages of Reference Embodiment

As described above, in Reference Embodiment, with the provision of the seal ring (81,91) which forms the intermediate-pressure back pressure chamber (85,95) on the back side of the movable-side end plate portion (52*a*,56*a*), the pressing force of the pressing mechanism (80,90) is made small during a period in which the intermediate injection operation is not performed during which the repelling force acting between the cylinders (52,56) is small. In a conventional compressor which gains a pressing force solely by means of high-pressure refrigerator oil introduced to the movable-side end plate portion (52*a*,56*a*) on the back side thereof, the pressing force of the pressing mechanism (80,90) is generally constant before and after the intermediate injection operation is stopped. In contrast, in the compressor (20) of Reference Embodiment, the pressing force is made small during a period in which the intermediate injection operation is not performed, thereby reducing the difference between the pressing force and the repelling force during a period in which the intermediate injection operation is not performed. Therefore, during a period in which the intermediate injection operation is not performed, the frictional force caused by the difference between the pressing force and the repelling force is reduced, thereby reducing the energy loss of the compression mechanism (30).

As the compressor (20) of the refrigerator (1) for performing the intermediate injection operation, Reference Embodiment employs the compressor (20) such that the pressing force of the pressing mechanism (80,90) is made small during a period in which the intermediate injection operation is not performed. This reduces the energy loss in the compressor (20) during a period in which the intermediate injection operation is not performed, thereby improving the operation efficiency of the refrigerator (1).

Embodiment 1

Embodiment 1 of the present invention is directed to a heat pump-type air conditioner (1) including the compressor (20) formed by the fluid machine (20) of the present invention for selectively heating and cooling the room. The refrigerant circuit (10) performing the refrigeration cycle is filled with carbon dioxide as refrigerant, as in Reference Embodiment. The air conditioner (1) differs from the air conditioner (1) of Reference Embodiment in terms of the configuration of the compressor (20) and how the compressor (20) is connected. Note however that it is the same as Reference Embodiment in that the first mechanism portion (24) and the second mechanism portion (25) of the compressor (20) are of a fixed-piston configuration. The following description will mainly focus on the differences from Reference Embodiment.

Figure 1:
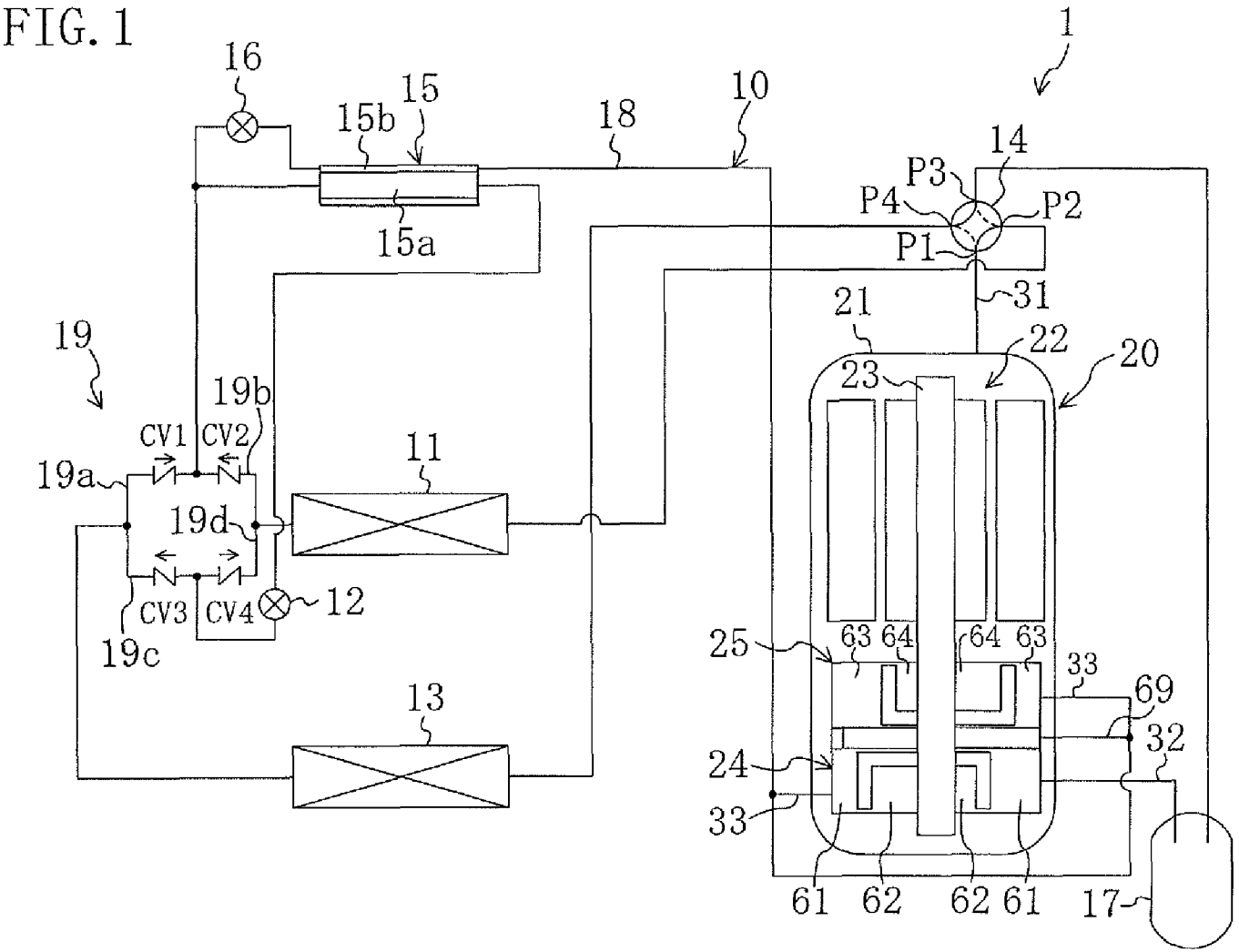
FIG. 1 is a piping diagram showing a refrigerant circuit of an air conditioner according to Embodiment 1.

As shown in FIG. 1, the compressor (20) of Embodiment 1 includes the first lower-stage compression chamber (61) and the second lower-stage compression chamber (62) formed in the first mechanism portion (24), and the first higher-stage compression chamber (63) and the second higher-stage compression chamber (64) formed in the second mechanism portion (25).

In Embodiment 1, the first mechanism portion (24) fauns a first eccentric rotation mechanism (24), and the second mechanism portion (25) forms a second eccentric rotation mechanism (25). In the first mechanism portion (24), the first lower-stage compression chamber (61) forms an outer fluid chamber (61), and the second lower-stage compression chamber (62) forms an inner fluid chamber (62). In the second mechanism portion (25), the first higher-stage compression chamber (63) forms an outer fluid chamber (63), and the second higher-stage compression chamber (64) forms an inner fluid chamber (64).

The suction pipe (32) forming an inflow passageway (32) is connected to the suction side of the first mechanism portion (24). The discharge side of the first mechanism portion (24) is connected to the suction side of the second mechanism portion (25) via the intermediate-pressure communication pipe (33) which forms a communication passageway (33).

Figure 2:
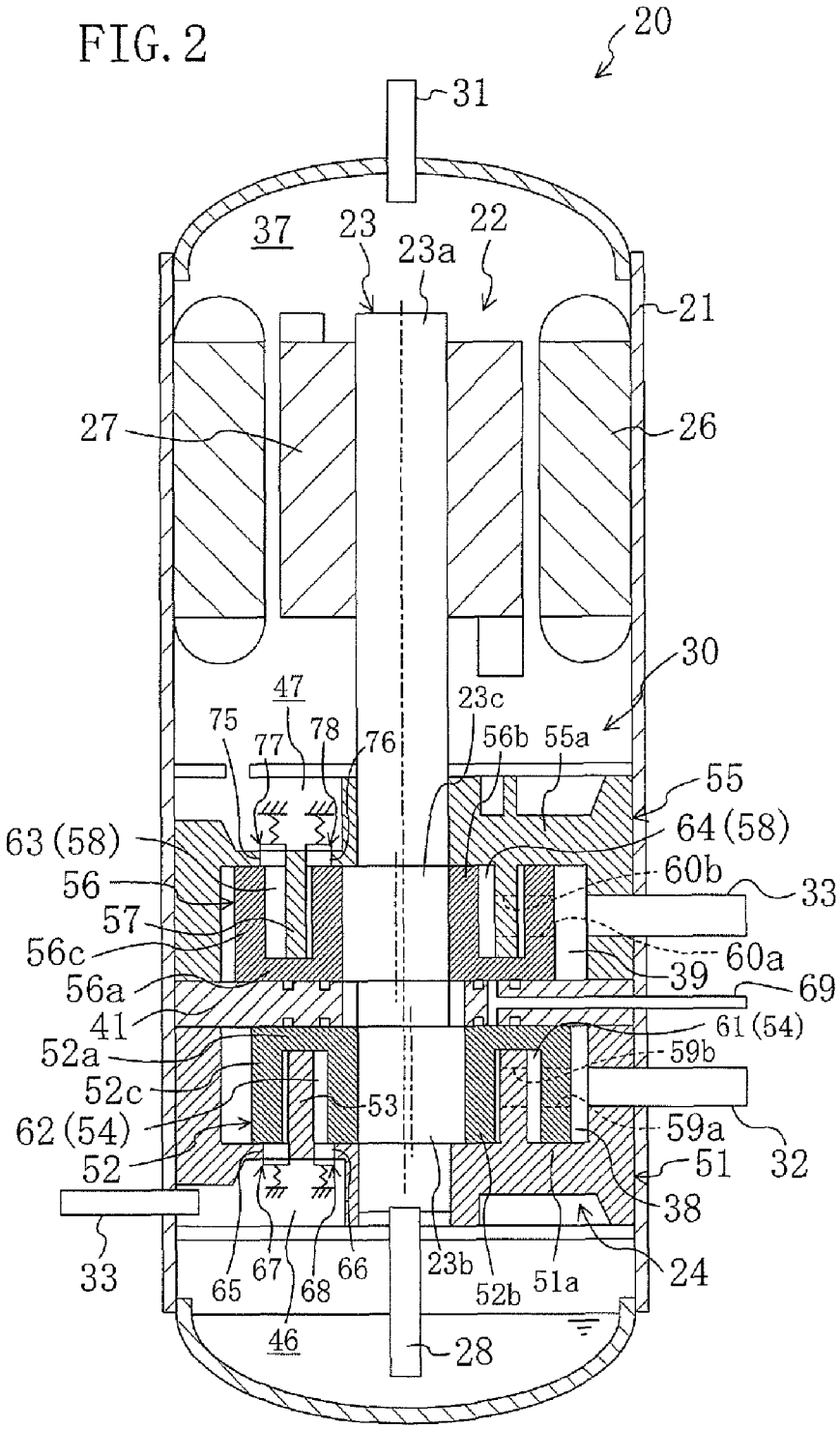
FIG. 2 is a vertical cross-sectional view showing a compressor according to Embodiment 1.
Figure 3:
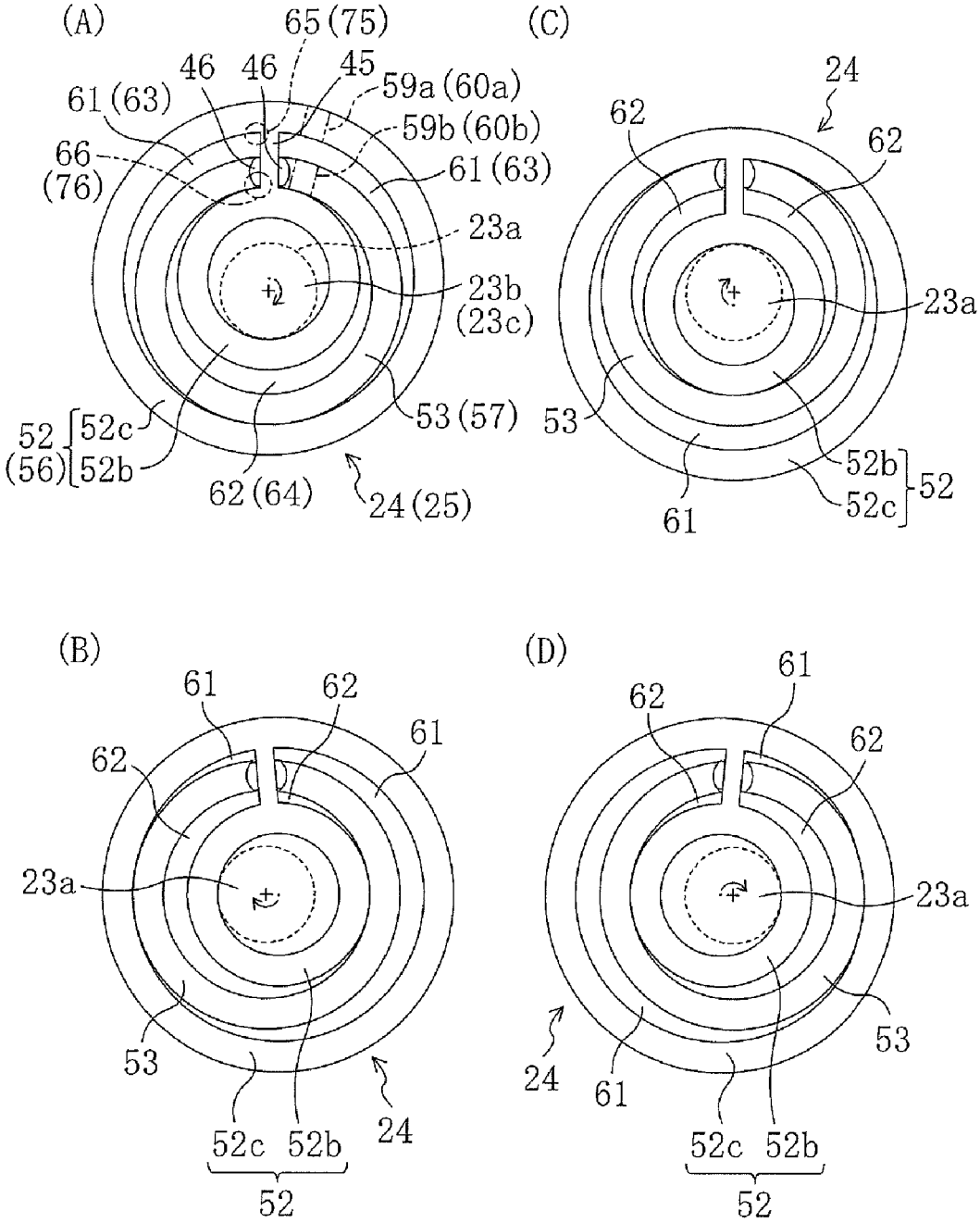
FIG. 3 is a lateral cross-sectional view showing a first mechanism portion (second mechanism portion) according to Embodiment 1.

As shown in FIGS. 2 and 3, in the first mechanism portion (24), the first lower-stage compression chamber (61) is formed between the outer circumferential surface of the first piston (53) and the outer wall of the first cylinder chamber (54), and the second lower-stage compression chamber (62) is formed between the inner circumferential surface of the first piston (53) and the inner wall of the first cylinder chamber (54).

In the first cylinder (52), a first outer communication passageway (59*a*) is formed in the outer cylinder portion (52*c*), and a first inner communication passageway (59*b*) is formed in the inner cylinder portion (52*b*). The first outer communication passageway (59*a*) communicates the suction space (38) on the outer side of the first cylinder (52) with the suction side of the first lower-stage compression chamber (61). The first inner communication passageway (59*b*) communicates the suction side of the first lower-stage compression chamber (61) with the suction side of the second lower-stage compression chamber (62). In the first mechanism portion (24), the suction side of the first lower-stage compression chamber (61) is connected to the suction pipe (32) via the first outer communication passageway (59*a*). The suction side of the second lower-stage compression chamber (62) is connected to the suction pipe (32) via the first outer communication passageway (59*a*) and the first inner communication passageway (59*b*).

In Embodiment 1, a single suction pipe (32) is used to form the inflow passageway (32) for introducing refrigerant from outside the compressor (20) into the first lower-stage compression chamber (61) and the second lower-stage compression chamber (62) of the first mechanism portion (24). This reduces the refrigerant flow rate variation through the inflow passageway (32).

In the first mechanism portion (24), the outer discharge port (65) and the inner discharge port (66) are formed in the first housing (51). The outer discharge port (65) communicates the discharge side of the first lower-stage compression chamber (61) with a first discharge space (46). The first discharge valve (67) is provided at the outer discharge port (65). The first discharge valve (67) is configured so as to open the outer discharge port (65) when the refrigerant pressure on the discharge side of the first lower-stage compression chamber (61) becomes greater than or equal to the refrigerant pressure of the first discharge space (46). On the other hand, the inner discharge port (66) communicates the discharge side of the second lower-stage compression chamber (62) with the first discharge space (46). The second discharge valve (68) is provided at the inner discharge port (66). The second discharge valve (68) is configured so as to open the inner discharge port (66) when the refrigerant pressure on the discharge side of the second lower-stage compression chamber (62) becomes greater than or equal to the refrigerant pressure of the first discharge space (46). The intermediate-pressure communication pipe (33) is opened into the first discharge space (46).

In Embodiment 1, the outer discharge port (65) and the inner discharge port (66) of the first mechanism portion (24) are opened into the same first discharge space (46). In the first mechanism portion (24), the refrigerant of the first lower-stage compression chamber (61) and the refrigerant of the second lower-stage compression chamber (62) are discharged into the same discharge space (46). Therefore, the first discharge space (46) is relatively large so as to accommodate the discharge flow rate from the two compression chambers (61, 62), and the intermediate-pressure communication pipe (33) extending from the first discharge space (46) also has a relatively large diameter.

In the second mechanism portion (25), the first higher-stage compression chamber (63) is formed between the outer circumferential surface of the second piston (57) and the outer wall of the second cylinder chamber (58), and the second higher-stage compression chamber (64) is formed between the inner circumferential surface of the second piston (57) and the inner wall of the second cylinder chamber (58).

In the second cylinder (56), a second outer communication passageway (60*a*) is formed in the outer cylinder portion (56*c*), and a second inner communication passageway (60*b*) is formed in the inner cylinder portion (56*b*). The second outer communication passageway (60*a*) communicates the suction space (39) on the outer side of the second cylinder (56) with the suction side of the first higher-stage compression chamber (63). The second inner communication passageway (60*b*) communicates the suction side of the first higher-stage compression chamber (63) with the suction side of the second higher-stage compression chamber (64). In the second mechanism portion (25), the suction side of the first higher-stage compression chamber (63) is connected to the intermediate-pressure communication pipe (33) via the second outer communication passageway (60*a*). The suction side of the second higher-stage compression chamber (64) is connected to the intermediate-pressure communication pipe (33) via the second outer communication passageway (60*a*) and the second inner communication passageway (60*b*).

In Embodiment 1, a single intermediate-pressure communication pipe (33) is used to form the communication passageway (33) for introducing refrigerant discharged from the first lower-stage compression chamber (61) and the second lower-stage compression chamber (62) of the first mechanism portion (24) into the first higher-stage compression chamber (63) and the second higher-stage compression chamber (64) of the second mechanism portion (25). This reduces the refrigerant flow rate variation through the communication passageway (33).

In the second mechanism portion (25), the outer discharge port (75) and the inner discharge port (76) are formed in the second housing (55). The outer discharge port (75) communicates the discharge side of the first higher-stage compression chamber (63) with a second discharge space (47). The third discharge valve (77) is provided at the outer discharge port (75). The third discharge valve (77) is configured so as to open the outer discharge port (75) when the refrigerant pressure on the discharge side of the first higher-stage compression chamber (63) becomes greater than or equal to the refrigerant pressure of the second discharge space (47). On the other hand, the inner discharge port (76) communicates the discharge side of the second higher-stage compression chamber (64) with the second discharge space (47). The fourth discharge valve (78) is provided at the inner discharge port (76). The fourth discharge valve (78) is configured so as to open the inner discharge port (76) when the refrigerant pressure on the discharge side of the second higher-stage compression chamber (64) becomes greater than or equal to the refrigerant pressure of the second discharge space (47). The second discharge space (47) communicates with the discharge pipe (31) forming an outflow passageway (31) via the inner space (37).

In Embodiment 1, the outer discharge port (75) and the inner discharge port (76) of the second mechanism portion (25) are opened into the same second discharge space (47). In the second mechanism portion (25), the refrigerant of the first higher-stage compression chamber (63) and the refrigerant of the second higher-stage compression chamber (64) are discharged into the same discharge space (47). Therefore, the second discharge space (47) is relatively large so as to accommodate the discharge flow rate from the two compression chambers (63,64).

Note that the configuration of the pressing mechanism (80,90) of Embodiment 1 is the same as Reference Embodiment. In Embodiment 1, the first pressing portion (80), which is provided for the first mechanism portion (24) where only the lower-stage compression chambers (61,62) are formed, includes the first inner seal ring (81*a*) and the first outer seal ring (81*b*) which form the intermediate-pressure back pressure chamber (85). The second pressing portion (90), which is provided for the second mechanism portion (25) where only the higher-stage compression chambers (63,64) are formed, includes the second inner seal ring (91*a*) and the second outer seal ring (91*b*) which form the intermediate-pressure back pressure chamber (95). Therefore, in the mechanism portions (24,25), the pressing mechanisms (80,90) have a smaller pressing force during a period in which the intermediate injection operation is not performed during which the repelling force acting between the cylinders (52,56) is smaller.

Here, where the suction volume ratio of the higher-stage compression chamber (63,64) with respect to the lower-stage compression chamber (61,62) is 1.0, for example, the pressure on the suction side and that on the discharge side of the lower-stage compression chamber (61,62) is equal to each other during a period in which the intermediate injection operation is not performed, and the pressure of the intermediate-pressure refrigerant becomes equal to the pressure of the refrigerant sucked into the lower-stage compression chamber (61,62). That is, during a period in which the intermediate injection operation is not performed, the refrigerant is not substantially compressed in the first mechanism portion (24), and the first cylinder (52) runs idle. In Embodiment 1, since the first pressing portion (80) has a smaller pressing force during a period in which the intermediate injection operation is not performed, the energy loss in the first cylinder (52) which runs idle is reduced.

Advantages of Embodiment 1

As described above, in Embodiment 1, the lower-stage compression chambers (61,62) and the higher-stage compression chambers (63,64) are formed in separate mechanism portions (24,25), and therefore the suction volume ratio can be adjusted by the ratio between the height of the first cylinder chamber (54) of the first mechanism portion (24) and the height of the second cylinder chamber (58) of the second mechanism portion (25) or by the ratio between the amount of eccentricity of the first eccentric portion (23*b*) and the amount of eccentricity of the second eccentric portion (23*c*). It is easy to adjust the ratio of height between the cylinder chambers (54,58) or the ratio of amount of eccentricity therebetween. Therefore, it is possible to easily set the suction volume ratio to a predetermined ratio.

In Embodiment 1, the refrigerant introduced into the outer fluid chamber (61,63) of the mechanism portion (24,25) and the refrigerant introduced into the inner fluid chamber (62,64) thereof flow through the same passageway, thus reducing the refrigerant flow rate variation in the inflow passageway (32) and in the communication passageway (33). Therefore, in the inflow passageway (32) and the communication passageway (33), it is possible to reduce the pressure pulsation caused by the refrigerant flow rate variation, and the vibration caused by the pressure pulsation.

In Embodiment 1, in the mechanism portion (24,25), the refrigerant of the outer fluid chamber (61,63) and the refrigerant of the inner fluid chamber (62,64) are discharged into the same discharge space (46,47). Therefore, the discharge space (46,47) is enlarged according to the discharge flow rate from the two fluid chambers, and the passageway extending from the discharge space (46,47) is also enlarged. Therefore, it is possible to reduce the pressure loss of the discharge refrigerant.

In Embodiment 1, since the first eccentric direction and the second eccentric direction are shifted from each other by 180°, the centrifugal load acting upon the first eccentric portion (23*b*) and the centrifugal load acting upon the second eccentric portion (23*c*) cancel out each other substantially. Thus, it is possible to significantly reduce the vibration due to the centrifugal load.

In Embodiment 1, the compressor (20) is connected to the refrigerant circuit (10) with a large pressure pulsation caused by the refrigerant flow rate variation. Therefore, there is a greater advantage from the configuration where the refrigerant introduced into the outer fluid chamber (61) of the first mechanism portion (24) and the refrigerant introduced into the inner fluid chamber (62) thereof flow through the same passageway, and the refrigerant introduced into the outer fluid chamber (63) of the second mechanism portion (25) and the refrigerant introduced into the inner fluid chamber (64) thereof flow through the same passageway, so as to reduce the pressure pulsation caused by the refrigerant flow rate variation. Note that advantages of Embodiment 1 described above are also obtained in Embodiment 2.

In Embodiment 1, a seal ring (91) is provided, on the back side of the movable-side end plate portion (56*a*), for the second mechanism portion (25), for which the rate of change of the repelling force in response to the stop of the intermediate injection operation is higher as compared with that for the first mechanism portion (24). That is, the seal ring (91) is provided on the back side of the movable-side end plate portion (56*a*) for the second mechanism portion (25), for which the energy loss due to the difference between the pressing force and the repelling force during a period in which the intermediate injection operation is not performed is greater as compared with that for the first mechanism portion (24), if the intermediate-pressure back pressure chambers (85,95) is not formed by the partition member (81,91) of Embodiment 1 on the back side of the movable-side end plate portions (52*a*, 56*a*). Therefore, there is a greater advantage from the provision of the intermediate-pressure back pressure chambers (85,95) with the second mechanism portion (25) than with the first mechanism portion (24), and it is therefore possible to effectively reduce the energy loss of the compression mechanism (30).

In Embodiment 1, a seal ring (81) is provided also on the back side of the movable-side end plate portion (52*a*) of the first mechanism portion (24), in addition to the second mechanism portion (25). Therefore, since it is possible to reduce the energy loss during a period in which the intermediate injection operation is not performed not only for the second mechanism portion (25) but also for the first mechanism portion (24), it is possible to reduce the energy loss of the compression mechanism (30).

Embodiment 2

Embodiment 2 of the present invention is similar to Embodiment 1, and is directed to the air conditioner (1) including the fluid machine (20) of the present invention. Embodiment 2 differs from Embodiment 1 in that the first mechanism portion (24) and the second mechanism portion (25) of the compressor (20) are of a moving-piston configuration. The following description will mainly focus on the differences from Embodiment 1.

Figure 4:
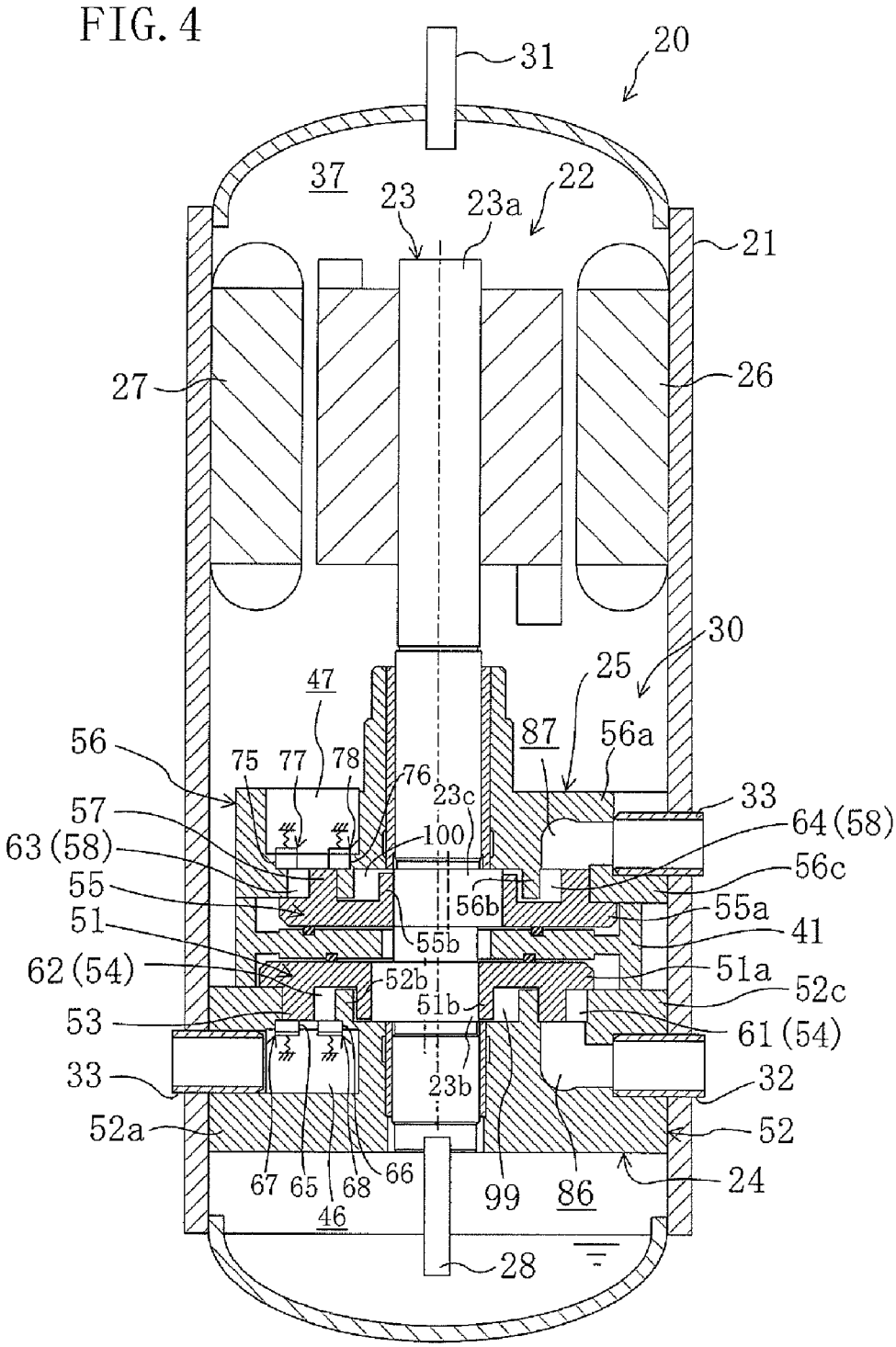
FIG. 4 is a vertical cross-sectional view showing a compressor according to Embodiment 2.
Figure 5:
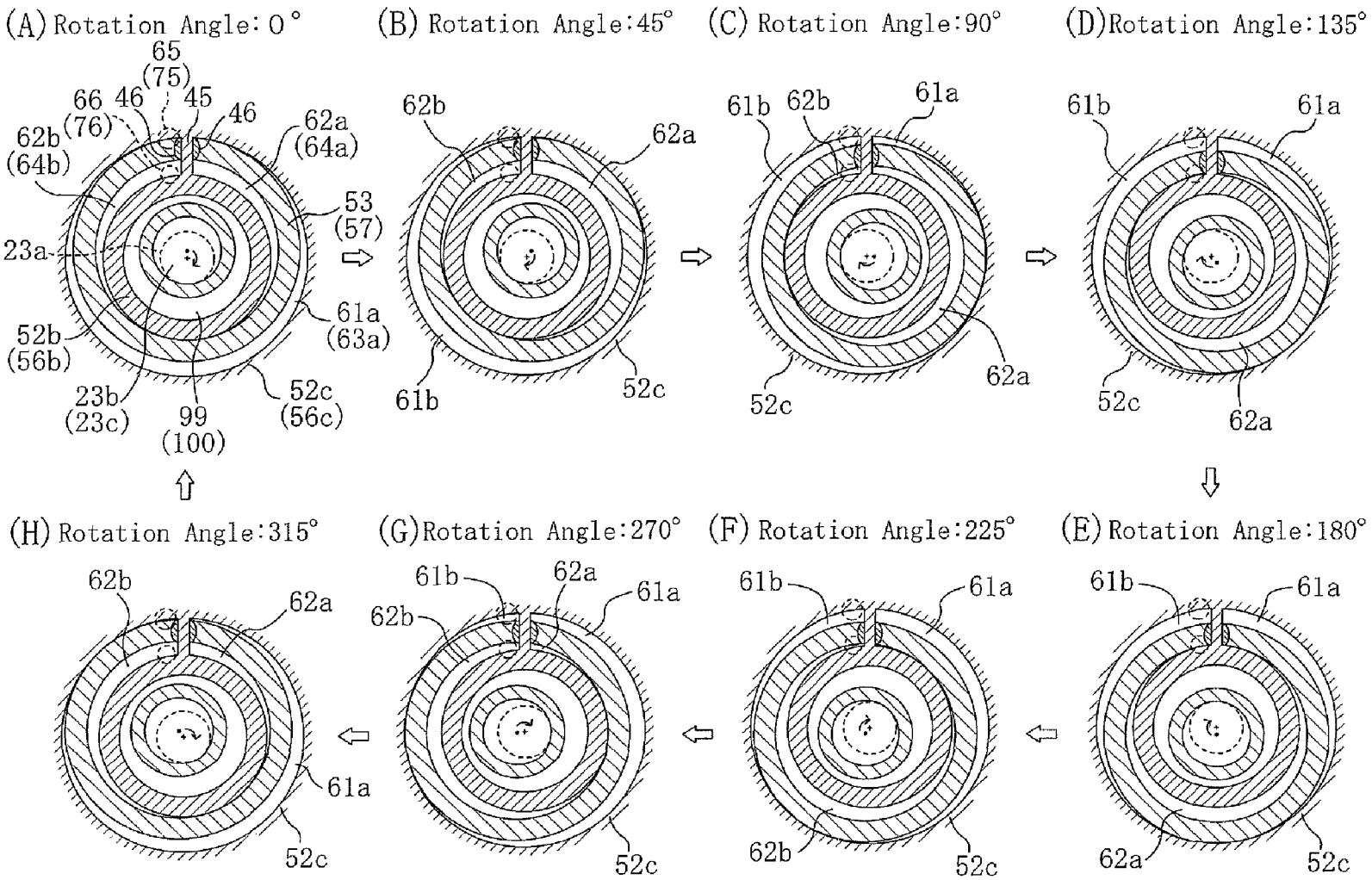
FIG. 5 is a lateral cross-sectional view showing a first mechanism portion (second mechanism portion) according to Embodiment 2.

As shown in FIGS. 4 and 5, the first mechanism portion (24) includes the first cylinder (52) fixed to the casing (21), and a first movable member (51) having the annular first piston (53) and being driven by the drive shaft (23). The first mechanism portion (24) is provided so that the back surface of a movable-side end plate portion (51*a*) to be described later faces toward the second mechanism portion (25). The first mechanism portion (24) forms the first eccentric rotation mechanism (24).

The first cylinder (52) includes the disc-shaped fixed-side end plate portion (52*a*), the annular inner cylinder portion (52*b*) protruding upwardly from an inner position on the upper surface of the fixed-side end plate portion (52*a*), and the annular outer cylinder portion (52*c*) protruding upwardly from the outer circumferential portion of the upper surface of the fixed-side end plate portion (52*a*). The first cylinder (52) includes the annular first cylinder chamber (54) between the inner cylinder portion (52*b*) and the outer cylinder portion (52*c*).

On the other hand, the first movable member (51) includes the disc-shaped movable-side end plate portion (51*a*), the first piston (53) described above, and an annular protruding portion (51*b*) protruding downwardly from the inner periphery edge portion of the lower surface of the movable-side end plate portion (51*a*). The movable-side end plate portion (51*a*) faces the first cylinder chamber (54), together with the fixed-side end plate portion (52*a*). The first piston (53) protrudes downwardly from a position slightly closer to the outer circumference of the lower surface of the movable-side end plate portion (51*a*). The first piston (53) is accommodated in the first cylinder chamber (54) while being eccentric with the first cylinder (52), and divides the first cylinder chamber (54) into the outer fluid chamber (61) and the inner fluid chamber (62).

Note that the first piston (53) and the first cylinder (52) are such that in a state where the outer circumferential surface of the first piston (53) and the inner circumferential surface of the outer cylinder portion (52*c*) are substantially in contact with each other at one point (a state where although there is a micron-order gap strictly speaking, there is no substantial leakage of refrigerant through the gap), the inner circumferential surface of the first piston (53) and the outer circumferential surface of the inner cylinder portion (52*b*) are substantially in contact with each other at one point at a position where the phase is 180° different from that of the first contact point. This similarly applies to the second mechanism portion (25), and also to the mechanism portions (24,25) of Embodiment 1 and Reference Embodiment.

The first eccentric portion (23*b*) is fitted in the annular protruding portion (51*b*). In response to the rotation of the drive shaft (23), the first movable member (51) rotates in eccentric rotation about the axis of the main shaft portion (23*a*). Note that in the first mechanism portion (24), a space (99) is formed between the annular protruding portion (51*b*) and the inner cylinder portion (52*b*), but the refrigerant is not compressed in the space (99).

As shown in FIG. 5, the first mechanism portion (24) includes the blade (45) extending from the outer circumferential surface of the inner cylinder portion (52*b*) to the inner circumferential surface of the outer cylinder portion (52*c*). The blade (45) is integral with the first cylinder (52). The blade (45) is arranged in the first cylinder chamber (54), divides the outer fluid chamber (61) into a first chamber (61*a*) on the suction side and a second chamber (61*b*) on the discharge side, and divides the inner fluid chamber (62) into a first chamber (62*a*) on the suction side and a second chamber (62*b*) on the discharge side. The blade (45) is inserted in the broken portion of the C-shaped first piston (53), which is in a partially broken annular shape. The semicircular bushes (46, 46) are fitted to the broken portions of the first piston (53) with the blade (45) interposed therebetween. The bushes (46,46) are configured so that they can swing relative to the end surface of the first piston (53). Thus, the first piston (53) can reciprocate in the direction in which the blade (45) extends, and can swing along with the bushes (46,46).

The suction pipe (32) forming the inflow passageway (32) is connected to the first mechanism portion (24). The suction pipe (32) is connected to a first connection passageway (86) formed in the fixed-side end plate portion (52*a*). The first connection passageway (86) on the entrance side extends in the radial direction of the fixed-side end plate portion (52*a*), is bent upward at a certain point, and on the exit side extends in the axial direction of the fixed-side end plate portion (52*a*). The exit end of the first connection passageway (86) is opened into both the outer fluid chamber (61) and the inner fluid chamber (62). In the first mechanism portion (24), the outer fluid chamber (61) serves as the first lower-stage compression chamber (61), and the inner fluid chamber (62) serves as the second lower-stage compression chamber (62). In Embodiment 2, as in Embodiment 1, a single suction pipe (32) is used to form the inflow passageway (32) for introducing refrigerant from outside the compressor (20) into the first lower-stage compression chamber (61) and the second lower-stage compression chamber (62) of the first mechanism portion (24).

In the first mechanism portion (24), there are formed the outer discharge port (65) through which refrigerant is discharged from the first lower-stage compression chamber (61) on the outer side, the inner discharge port (66) through which refrigerant is discharged from the second lower-stage compression chamber (62) on the inner side, and the first discharge space (46) into which the outer discharge port (65) and the inner discharge port (66) are both opened. The outer discharge port (65) communicates the second chamber (61*b*) of the first lower-stage compression chamber (61) with the first discharge space (46). The first discharge valve (67) is provided at the outer discharge port (65). On the other hand, the inner discharge port (66) communicates the second chamber (62*b*) of the second lower-stage compression chamber (62) with the first discharge space (46). The second discharge valve (68) is provided at the inner discharge port (66). The entrance end of the intermediate-pressure communication pipe (33) forming the communication passageway (33) is opened into the first discharge space (46). In Embodiment 2, as in Embodiment 1, the outer discharge port (65) and the inner discharge port (66) of the first mechanism portion (24) are opened into the same discharge space (46).

With such a configuration, as the drive shaft (23) rotates, the first piston (53) rotates in eccentric rotation in the order from (A) to (H) in FIG. 5. Along with the eccentric rotation, low-pressure refrigerant, which has been introduced through the suction pipe (32), is compressed in the first lower-stage compression chamber (61) and the second lower-stage compression chamber (62). The refrigerant discharged from the first lower-stage compression chamber (61) and the second lower-stage compression chamber (62) flows into the intermediate-pressure communication pipe (33).

The second mechanism portion (25) is formed by the same mechanical components as those of the first mechanism portion (24). The second mechanism portion (25) is upside down with respect to the first mechanism portion (24) with the middle plate (41) to be described later interposed therebetween.

Specifically, the second mechanism portion (25) includes the second cylinder (56) fixed to the casing (21), and a second movable member (55) having the annular second piston (57) and being driven by the drive shaft (23). The second mechanism portion (25) is provided so that the back surface of a movable-side end plate portion (55*a*) to be described later faces toward the first mechanism portion (24). The second mechanism portion (25) forms the second eccentric rotation mechanism (25).

The second cylinder (56) includes the disc-shaped fixed-side end plate portion (56*a*), the annular inner cylinder portion (56*b*) protruding downwardly from an inner position on the lower surface of the fixed-side end plate portion (56*a*), and the annular outer cylinder portion (56*c*) protruding downwardly from the outer circumferential portion of the lower surface of the fixed-side end plate portion (56*a*). The second cylinder (56) includes the annular second cylinder chamber (58) between the inner cylinder portion (56*b*) and the outer cylinder portion (56*c*).

On the other hand, the second movable member (55) includes the disc-shaped movable-side end plate portion (55*a*), the second piston (57) described above, and an annular protruding portion (55*b*) protruding upwardly from the inner periphery edge portion of the upper surface of the movable-side end plate portion (55*a*). The movable-side end plate portion (55*a*) faces the second cylinder chamber (58), together with the fixed-side end plate portion (56*a*). The second piston (57) protrudes upwardly from a position slightly closer to the outer circumference of the upper surface of the movable-side end plate portion (55*a*). The second piston (57) is accommodated in the second cylinder chamber (58) while being eccentric with the second cylinder (56), and divides the second cylinder chamber (58) into the outer fluid chamber (63) and the inner fluid chamber (64). The second eccentric portion (23*c*) is fitted in the annular protruding portion (55*b*). In response to the rotation of the drive shaft (23), the second movable member (55) rotates in eccentric rotation about the axis of the main shaft portion (23*a*). Note that in the second mechanism portion (25), a space (100) is formed between the annular protruding portion (55*b*) and the inner cylinder portion (56*b*), but the refrigerant is not compressed in the space (100).

The second mechanism portion (25) includes the blade (45) extending from the outer circumferential surface of the inner cylinder portion (56*b*) to the inner circumferential surface of the outer cylinder portion (56*c*). The blade (45) is integral with the second cylinder (56). The blade (45) is arranged in the second cylinder chamber (58), divides the outer fluid chamber (63) into a first chamber (63*a*) on the suction side and a second chamber (63*b*) on the discharge side, and divides the inner fluid chamber (64) into a first chamber (64*a*) on the suction side and a second chamber (64*b*) on the discharge side. The blade (45) is inserted in the broken portion of the C-shaped second piston (57), which is in a partially broken annular shape. The semicircular bushes (46,46) are fitted to the broken portions of the second piston (57) with the blade (45) interposed therebetween. The bushes (46,46) are configured so that they can swing relative to the end surface of the second piston (57). Thus, the second piston (57) can reciprocate in the direction in which the blade (45) extends, and can swing along with the bushes (46,46).

The intermediate-pressure communication pipe (33) is connected to the second mechanism portion (25). The intermediate-pressure communication pipe (33) is connected to a second connection passageway (87) formed in the fixed-side end plate portion (56*a*). The second connection passageway (87) on the entrance side extends in the radial direction of the fixed-side end plate portion (56*a*), is bent downward at a certain point, and on the exit side extends in the axial direction of the fixed-side end plate portion (56*a*). The exit end of the second connection passageway (87) is opened into both the outer fluid chamber (63) and the inner fluid chamber (64). In the second mechanism portion (25), the outer fluid chamber (63) serves as the first higher-stage compression chamber (63), and the inner fluid chamber (64) serves as the second higher-stage compression chamber (64). In Embodiment 2, as in Embodiment 1, a single intermediate-pressure communication pipe (33) is used to form the communication passageway (33) for introducing refrigerant which has been discharged from the first lower-stage compression chamber (61) and the second lower-stage compression chamber (62) of the first mechanism portion (24) into the first higher-stage compression chamber (63) and the second higher-stage compression chamber (64) of the second mechanism portion (25).

In the second mechanism portion (25), there are formed the outer discharge port (75) through which refrigerant is discharged from the first higher-stage compression chamber (63) on the outer side, the inner discharge port (76) through which refrigerant is discharged from the second higher-stage compression chamber (64) on the inner side, and the second discharge space (47) into which the outer discharge port (75) and the inner discharge port (76) are both opened. The outer discharge port (75) communicates the second chamber (63*b*)

of the first higher-stage compression chamber (63) with the second discharge space (47). The third discharge valve (77) is provided at the outer discharge port (75). On the other hand, the inner discharge port (76) communicates the second chamber (64*b*) of the second higher-stage compression chamber (64) with the second discharge space (47). The fourth discharge valve (78) is provided at the inner discharge port (76). The second discharge space (47) communicates with the discharge pipe (31) forming the outflow passageway (31) via the inner space (37). In Embodiment 2, as in Embodiment 1, the outer discharge port (75) and the inner discharge port (76) of the second mechanism portion (25) are opened into the same discharge space (47).

With such a configuration, the second piston (57) rotates in eccentric rotation, as does the first piston (53), in response to the rotation of the drive shaft (23). Along with the eccentric rotation, intermediate-pressure refrigerant which has been introduced through the intermediate-pressure communication pipe (33) is compressed in the first higher-stage compression chamber (63) and the second higher-stage compression chamber (64). Refrigerant which has been discharged from the first higher-stage compression chamber (63) and the second higher-stage compression chamber (64) flows into the discharge pipe (31).

In Embodiment 2, as in Embodiment 1, the first eccentric portion (23*b*) and the second eccentric portion (23*c*) are shifted in phase from each other by 180° about the axis of the drive shaft (23). That is, the first eccentric direction in which the first eccentric portion (23*b*) is eccentric with the main shaft portion (23*a*) is shifted by 180° from the second eccentric direction in which the second eccentric portion (23*c*) is eccentric with the main shaft portion (23*a*).

The compressor (20) of Embodiment 2 is designed so that the suction volume ratio, which is the total suction volume of the first higher-stage compression chamber (63) and the second higher-stage compression chamber (64) with respect to the total suction volume of the first lower-stage compression chamber (61) and the second lower-stage compression chamber (62), is 1.0, for example. Specifically, between the first mechanism portion (24) and the second mechanism portion (25), the cylinder chambers (54,58) and the pistons (53,57) have the same cross-sectional shapes and the same sizes, and the cylinder chambers (54,58) have an equal height. The amount of eccentricity of the first eccentric portion (23*b*) is equal to the amount of eccentricity of the second eccentric portion (23*c*). Therefore, the suction volume of the first lower-stage compression chamber (61) is equal to the suction volume of the first higher-stage compression chamber (63), and the suction volume of the second lower-stage compression chamber (62) is equal to the suction volume of the second higher-stage compression chamber (64). Therefore, the total suction volume of the first lower-stage compression chamber (61) and the second lower-stage compression chamber (62) is equal to the total suction volume of the first higher-stage compression chamber (63) and the second higher-stage compression chamber (64), resulting in a suction volume ratio of 1.0.

Note that in Embodiment 2, the lower-stage compression chambers (61,62) and the higher-stage compression chambers (63,64) are formed in different mechanism portions (24, 25), and where the suction volume ratio is changed to another ratio (e.g., 0.8), the suction volume ratio can be set to the predetermined ratio by adjusting at least one of the height ratio, which is the ratio between the height of the first cylinder chamber (54) of the first mechanism portion (24) and the height of the second cylinder chamber (58) of the second mechanism portion (25), and the eccentricity degree ratio, which is the ratio between the amount of eccentricity of the first eccentric portion (23*b*) and the amount of eccentricity of the second eccentric portion (23*c*).

Where the suction volume ratio is changed to another ratio (e.g., 0.8), one may adjust only the height ratio, among the height ratio and the eccentricity degree ratio. The height ratio is set to be equal to the intended suction volume ratio. Between the first mechanism portion (24) and the second mechanism portion (25), the heights of the cylinder chambers (54,58) are different from each other.

Where only the height ratio is adjusted, the sizes of the end plate portions (51*a*,55*a*) which account for a major part of the movable members (51,55) can be made the same between the first mechanism portion (24) and the second mechanism portion (25). Therefore, the weight difference between the first movable member (51) and the second movable member (55) can be made small. Thus, since there is a small difference between the torque variation for driving the first movable member (51) and the torque variation for driving the second movable member (55), the torque variations are likely to be canceled out by each other, and it is therefore possible to reduce the vibration caused by the torque variation.

Where the suction volume ratio is set to another ratio (e.g., 0.8), one may adjust only the eccentricity degree ratio, among the height ratio and the eccentricity degree ratio. The first eccentric portion (23*b*) and the second eccentric portion (23*c*) have different degrees of eccentricity from each other.

Where only the eccentricity degree ratio is adjusted, between the first mechanism portion (24) and the second mechanism portion (25), the cylinder chambers (54,58) and the pistons (53,57) have the same cross-sectional shapes and the same sizes, the cylinder chambers (54,58) have an equal height, and the pistons (53,57) have an equal height. Therefore, the same movable member (51,55) can be used for the first mechanism portion (24) and for the second mechanism portion (25). It is also possible to share the same cylinder (52,56).

Figure 6:
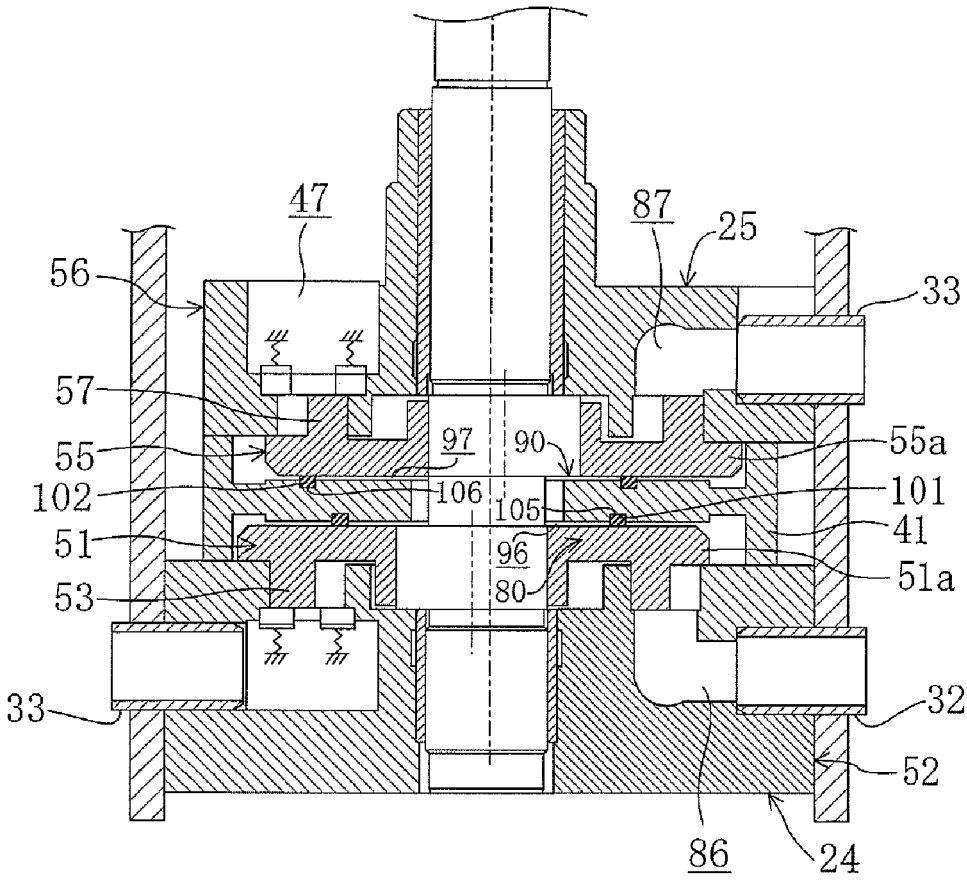
FIG. 6 is an enlarged cross-sectional view showing a pressing mechanism according to Embodiment 2.

In Embodiment 2, as in Embodiment 1, the pressing mechanisms (80,90) are provided as shown in FIG. 6, including the middle plate (41) interposed between the movable-side end plate portion (51*a*) of the first mechanism portion (24) and the movable-side end plate portion (55*a*) of the second mechanism portion (25), the first pressing portion (80), and the second pressing portion (90).

The first pressing portion (80) includes a first seal ring (101) forming a first high-pressure back pressure chamber (96). The first seal ring (101) is fitted into a first annular groove (105) formed on the lower surface of the middle plate (41) so as to surround the insertion hole of the middle plate (41) in which the drive shaft (23) is inserted. The center of the first annular groove (105) is shifted to the discharge side (to the left in FIG. 4) from the axis of the drive shaft (23). The first high-pressure back pressure chamber (96) is formed on the inner side of the first seal ring (101), between the lower surface of the middle plate (41) and the upper surface of the movable-side end plate portion (51*a*). The first high-pressure back pressure chamber (96) communicates with the gap around the drive shaft (23).

Here, the refrigerator oil in the oil reservoir is supplied to the outer circumferential surface of the drive shaft (23) through the oil supply passageway in the drive shaft (23). The oil reservoir is under a high pressure. Thus, the gap around the drive shaft (23) is a high-pressure space, and the first high-pressure back pressure chamber (96) is a high-pressure space.

The second pressing portion (90) includes a second seal ring (102) forming a second high-pressure back pressure chamber (97). Second seal ring (102) is fitted into a second annular groove (106) formed on the upper surface of the middle plate (41) so as to surround the insertion hole of the middle plate (41) in which the drive shaft (23) is inserted. The center of the second annular groove (106) is shifted to the discharge side (to the left in FIG. 4) from the axis of the drive shaft (23). The second high-pressure back pressure chamber (97) is formed on the inner side of second seal ring (102), between the upper surface of the middle plate (41) and the lower surface of the movable-side end plate portion (55*a*). The second high-pressure back pressure chamber (97) communicates with the gap around the drive shaft (23). The second high-pressure back pressure chamber (97) is a high-pressure space.

In Embodiment 2, the second seal ring (102) is formed with a larger diameter than the first seal ring (101). Therefore, the pressing force of the second pressing portion (90) for pressing the movable member (51,55) onto the cylinder (52,56) is greater than that of the first pressing portion (80). Note that the first seal ring (101) and the second seal ring (102) form parts of a partition structure or means (101,102).

Advantages of Embodiment 2

Figure 7:
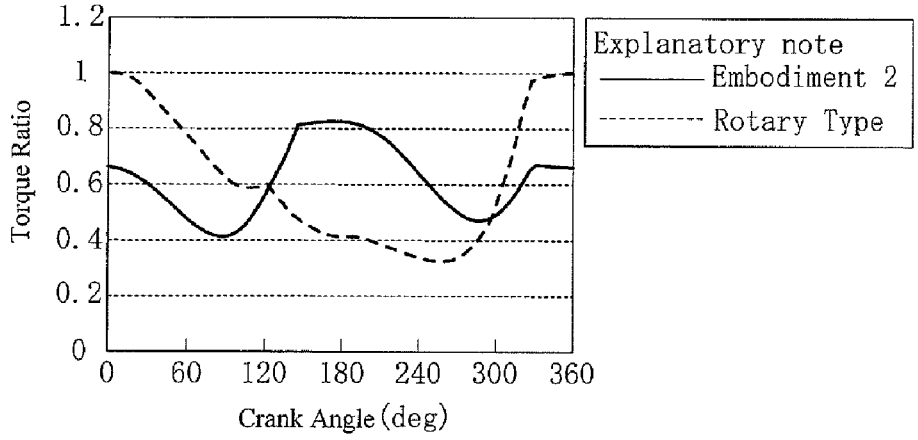
FIG. 7 is a graph showing variations in the torque ratio of the compressor of Embodiment 2 and variations in the torque ratio of the rotary-type compressor in response to changes in the crank angle (the rotation angle of the drive shaft).

In Embodiment 2, two fluid chambers (61-64) are formed in each mechanism portion (24,25). In each mechanism portion (24,25), the phase of volume change of the outer fluid chamber (61,63) is shifted by 180° from that of the inner fluid chamber (62,64). That is, in each mechanism portion (24,25), the phase of pressure variation of the outer fluid chamber (61,63) is shifted from that of the inner fluid chamber (62,64). Thus, for each mechanism portion (24,25), the torque variation range can be made smaller as compared with that of a configuration with only one fluid chamber such as a rotary-type eccentric rotation mechanism, for example, as shown in FIG. 7. Thus, it is possible to reduce the vibration of the compressor (20).

Note that the torque ratio in FIG. 7 represents values with the maximum torque of a rotary-type compressor being 1. The torque ratio of the compressor (20) of Embodiment 2 in FIG. 7 represents values obtained where the phase difference between the first eccentric portion (23*b*) and the second eccentric portion (23*c*) is 180° and the suction volume ratio is 0.9.

The torque ratio variation range (the difference between the maximum value and the minimum value) of the compressor (20) of Embodiment 2 is about 0.4, which is substantially smaller than the torque ratio variation range (the torque variation ratio) of a rotary-type compressor, which is a little less than 0.7. Note that although FIG. 7 shows values obtained for a moving-piston configuration, the torque variation range is smaller than that of a rotary-type compressor also with a fixed-piston configuration.

Figure 8:
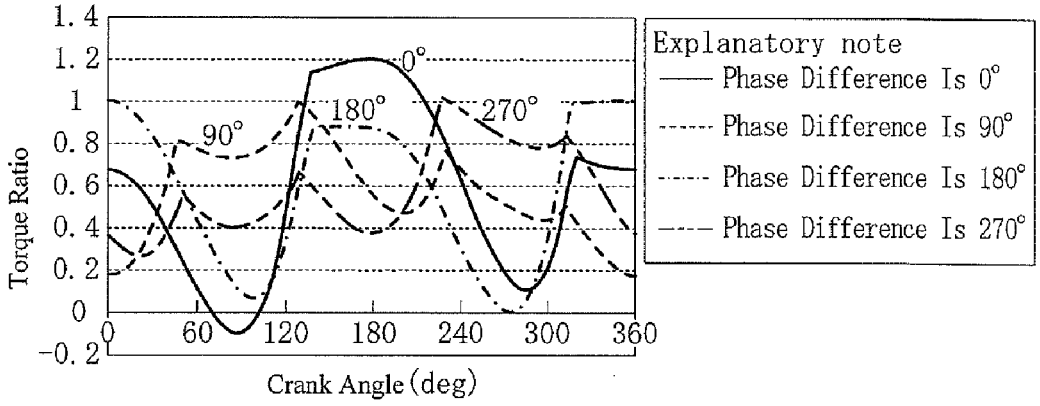
FIG. 8 is a graph showing variations in the torque ratio of the compressor of Embodiment 2 in response to changes in the crank angle, for each of different phase differences between the first eccentric portion and the second eccentric portion.

FIG. 8 shows the torque ratio variation for each of phase differences (0°, 90°, 180°, 270°) between the first eccentric portion (23*b*) and the second eccentric portion (23*c*). Note that FIG. 8 is drawn so that the torque ratio variation range for the phase difference of 180° between the first eccentric portion (23*b*) and the second eccentric portion (23*c*) is 1.

Figure 9:
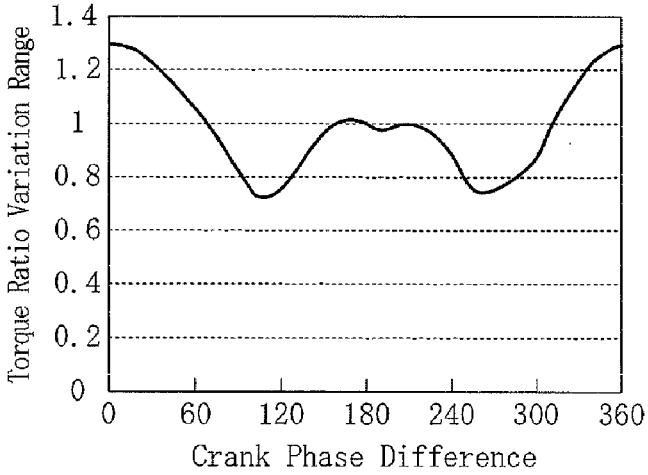
FIG. 9 is a graph showing the relationship between the phase difference between the first eccentric portion and the second eccentric portion and the range of variation of the torque.

FIG. 9 shows the relationship between the phase difference between the first eccentric portion (23*b*) and the second eccentric portion (23*c*) and the torque ratio variation range. FIG. 9 is drawn so that the torque ratio variation range for the phase difference of 180° between the first eccentric portion (23*b*) and the second eccentric portion (23*c*) is 1. As can be seen from FIG. 9, although the torque ratio variation range of the compressor (20) of Embodiment 2 is slightly larger than 1.0 when the phase difference is in the range of about 160°-180°, it is generally 1.0 or less when the phase difference between the first eccentric portion (23*b*) and the second eccentric portion (23*c*) is in the range of 60° or more and 310° or less. That is, the torque ratio variation range is generally 1.0 or less over a range of phase difference of 60° or more and 310° or less, which includes areas where the torque ratio variation range is slightly larger than 1.0. Therefore, the phase difference between the first eccentric portion (23*b*) and the second eccentric portion (23*c*) may be set to a value (e.g., 120°, 240°) in the range of 60° or more and 310° or less. Note that there is a similar tendency also with a fixed-piston configuration.

In Embodiment 2, each mechanism portion (24,25) employs the moving-piston configuration, where the distance between the center of gravity of the swinging member and the swing fulcrum remains constant. Therefore, the difference between the swing moment of the first mechanism portion (24) and the swing moment of the second mechanism portion (25) does not vary. Since the first eccentric direction and the second eccentric direction are shifted from each other by 180°, the swing moment of the first mechanism portion (24) and the swing moment of the second mechanism portion (25) are canceled out by each other. Therefore, since the swing moment of the first mechanism portion (24) and the swing moment of the second mechanism portion (25) are always significantly canceled out by each other, it is possible to reduce the vibration due to the swing moment.

In Embodiment 2, the high-pressure back pressure chambers (96,97) are formed by the partition structure (101,102) on the back of the movable-side end plate portion (51*a*) of the first mechanism portion (24) and on the back of the movable-side end plate portion (55*a*) of the second mechanism portion (25). The high-pressure back pressure chamber (96,97) of each mechanism portion (24,25) is adjusted to a high pressure. Therefore, it is only necessary to partition the outside of the high-pressure back pressure chamber (96,97), and it is therefore possible to simplify the configuration of the partition structure (101,102).

In Embodiment 2, the high-pressure back pressure chamber (96) of the first mechanism portion (24) and the high-pressure back pressure chamber (97) of the second mechanism portion (25) are formed by separate seal rings (101,102). Therefore, the area of the high-pressure back pressure chamber (96) of the first mechanism portion (24) and the area of the high-pressure back pressure chamber (97) of the second mechanism portion (25) can each be set according to the repelling force. Therefore, for the first mechanism portion (24) for which the repelling force is small, it is possible to prevent the pressing force from being excessive with respect to the repelling force, and it is therefore possible to reduce the friction loss of the first mechanism portion (24).

Other Embodiments

The embodiments above may employ configurations as follows.

In the embodiments above, the fluid machine (20) may be connected to the refrigerant circuit (10), as an expander (20) for expanding the refrigerant. In such a case, each fluid chamber (61,62) of the first mechanism portion (24) serves as a higher-stage fluid chamber for depressurizing high-pressure refrigerant to an intermediate pressure, and each fluid chamber (63,64) of the second mechanism portion (25) serves as a lower-stage fluid chamber for depressurizing intermediate-pressure refrigerant to a low pressure.

In the embodiments above, the refrigerant to be charged in the refrigerant circuit (10) may be refrigerant other than carbon dioxide (e.g., chlorofluorocarbon refrigerant). In such a case, the compressor (20) is configured for use with chlorofluorocarbon refrigerant. The compressor (20) for use with chlorofluorocarbon refrigerant is designed so that the suction volume ratio of the higher-stage compression chamber (63, 64) with respect to the lower-stage compression chamber (61,62) is smaller (e.g., 0.7) than that of a compressor for use with carbon dioxide.

In the embodiments above, the compressor (20) may be a low pressure dome-type compressor.

Note that the embodiments described above are essentially preferred embodiments, and are not intended to limit the scope of the present invention, the applications thereof, or the uses thereof.

INDUSTRIAL APPLICABILITY

As described above, the present invention is useful for a fluid machine for compressing fluid or expanding fluid.

What is claimed is:

1. A fluid machine comprising:

a first eccentric rotation mechanism and a second eccentric rotation mechanism, each of the first and second eccentric rotation mechanisms including a cylinder having an annular cylinder chamber, an annular piston disposed eccentrically in the cylinder chamber to divide the cylinder chamber into an outer fluid chamber and an inner fluid chamber, and a blade arranged in the cylinder chamber to divide each of the inner and outer fluid chambers into a first chamber and a second chamber, the cylinder and the piston being arranged and configured to move in eccentric rotation relative to each other in order to compress or expand fluid in each of the inner and outer fluid chambers;

a drive shaft including a main shaft portion, a first eccentric portion arranged to engage the first eccentric rotation mechanism and being eccentrically disposed relative to a rotation axis of the main shaft portion, and a second eccentric portion arranged to engage the second eccentric rotation mechanism and being eccentrically disposed relative to the rotation axis of the main shaft portion;

an inflow passageway arranged and configured to introduce fluid from outside into the inner and outer fluid chambers of the first eccentric rotation mechanism;

a communication passageway arranged and configured to introduce fluid discharged from the inner and outer fluid chambers of the first eccentric rotation mechanism into the inner and outer fluid chambers of the second eccentric rotation mechanism; and an outflow passageway arranged and configured to allow fluid discharged from the inner and outer fluid chambers of the second eccentric rotation mechanism to flow to outside.

2. The fluid machine of claim 1, wherein the first and second eccentric rotation mechanisms, the inflow passageway and the communication passageway are arranged and configured such that the fluid introduced from outside is compressed in the inner and outer fluid chambers of the first eccentric rotation mechanism, and the fluid which has been compressed in the inner and outer fluid chambers of the first eccentric rotation mechanism is further compressed in the inner and outer fluid chambers of the second eccentric rotation mechanism.

3. The fluid machine of claim 2, wherein the cylinders and the pistons of the first and second eccentric rotation mechanisms include end plate portions with front surfaces facing the inner and outer fluid chambers, the end plate portions of either the cylinders or the pistons of the first and second eccentric rotation mechanisms that move eccentrically form movable-side end plate portions, and the fluid machine further comprises a partition structure arranged and configured to form a high-pressure back pressure chambers communicating with a gap surrounding the drive shaft, the high-pressure back pressure chambers being arranged and configured to provide a pressure of fluid discharged from the second eccentric rotation mechanism on a back surface of the movable-side end plate portion of the first eccentric rotation mechanism and on a back surface of the movable-side end plate portion of the second eccentric rotation mechanism.

4. The fluid machine of claim 3, wherein the first eccentric rotation mechanism is arranged so that the back surface of the movable-side end plate portion thereof faces toward the second eccentric rotation mechanism, the second eccentric rotation mechanism is arranged so that the back surface of the movable-side end plate portion thereof faces toward the first eccentric rotation mechanism, the fluid machine further comprises a middle plate interposed between the back surface of the movable-side end plate portion of the first eccentric rotation mechanism and the back surface of the movable-side end plate portion of the second eccentric rotation mechanism, and the partition structure includes a first seal ring arranged and configured to form the high-pressure back pressure chamber between a first surface of the middle plate and the back surface of the movable-side end plate portion of the first eccentric rotation mechanism, and a second seal ring arranged and configured to form the high-pressure back pressure chamber between a second surface of the middle plate and the back surface of the movable-side end plate portion of the second eccentric rotation mechanism.

5. The fluid machine of claim 2, wherein the inflow passageway includes one passageway communicated to the outer fluid chamber and the inner fluid chamber of the first eccentric rotation mechanism, and the communication passageway includes one passageway communicated to the outer fluid chamber and the inner fluid chamber of the second eccentric rotation mechanism.

6. The fluid machine of claim 1, wherein the inflow passageway includes one passageway communicated to the outer fluid chamber and the inner fluid chamber of the first eccentric rotation mechanism, and the communication passageway includes one passageway communicated to the outer fluid chamber and the inner fluid chamber of the second eccentric rotation mechanism.

7. The fluid machine of claim 1, wherein each eccentric rotation mechanism includes an outer discharge port arranged and configured to discharge fluid from the outer fluid chamber thereof, and an inner discharge port arranged and configured to discharge fluid from the inner fluid chamber thereof, the outer discharge port and the inner discharge port of the first eccentric rotation mechanism are arranged and configured to open into a first discharge space which communicates with the communication passageway, and the outer discharge port and the inner discharge port of the second eccentric rotation mechanism are arranged and configured to open into a second discharge space which communicates with the outflow passageway.

8. The fluid machine of claim 1, wherein each eccentric rotation mechanism is arranged and configured so that the piston moves eccentrically and the cylinder is fixed.

9. The fluid machine of claim 1, wherein the cylinder chambers of the first eccentric rotation mechanism and the second eccentric rotation mechanism have different heights.

10. The fluid machine of claim 1, wherein the first eccentric portion has a first center axis spaced a first distance from the rotation axis of the main shaft portion and the second eccentric portion has a second center axis spaced a second distance from the rotation axis of the main shaft portion, and the first and second distances are different.

11. The fluid machine of claim 1, wherein a first center axis of the first eccentric portion is spaced in a first eccentric direction from the rotation axis of the main shaft portion, a second center axis of the second eccentric portion is spaced in a second eccentric direction from the rotation axis of the main shaft portion, and the first and second eccentric directions are shifted from each other by a predetermined angle of 60° or more and 310° or less.

12. The fluid machine of claim 11, wherein the first eccentric direction and the second eccentric direction are shifted from each other by 180°.

13. The fluid machine of claim 1, wherein the fluid machine is connected to a refrigerant circuit filled with carbon dioxide as refrigerant in order to perform a refrigeration cycle.

* * * * *